US008496213B1

(12) United States Patent
Kunert et al.

(10) Patent No.: US 8,496,213 B1
(45) Date of Patent: Jul. 30, 2013

(54) SYSTEM AND APPARATUS FOR MOBILE INFORMATION HANDLING

(75) Inventors: Steven R. Kunert, Cedar Rapids, IA (US); Blayne E. Medema, Cedar Rapids, IA (US); Matthew Miller, Cedar Rapids, IA (US); Paul C. Smith, Cedar Rapids, IA (US)

(73) Assignee: Mobile Oasis LLC, Hiawatha, IA (US)

( * ) Notice: Subject to any disclaimer, the term of this patent is extended or adjusted under 35 U.S.C. 154(b) by 1033 days.

(21) Appl. No.: 11/974,507

(22) Filed: Oct. 12, 2007

Related U.S. Application Data

(63) Continuation-in-part of application No. 11/401,111, filed on Apr. 10, 2006, now Pat. No. 7,997,819.

(60) Provisional application No. 60/669,619, filed on Apr. 8, 2005, provisional application No. 60/851,253, filed on Oct. 12, 2006.

(51) Int. Cl.
*A47B 96/00* (2006.01)

(52) U.S. Cl.
USPC ..... 248/176.1; 361/679.48

(58) Field of Classification Search
USPC ... 165/47, 121; 361/679.48–679.5; 248/176.1
See application file for complete search history.

(56) References Cited

U.S. PATENT DOCUMENTS

| | | | | |
|---|---|---|---|---|
| 2,621,807 | A * | 12/1952 | Rendich | 269/54.5 |
| 4,989,846 | A * | 2/1991 | Quinn | 269/54.5 |
| 5,450,271 | A * | 9/1995 | Fukushima et al. | 361/679.43 |
| 5,769,369 | A * | 6/1998 | Meinel | 248/176.1 |
| 6,233,148 | B1 * | 5/2001 | Shen | 361/695 |
| 6,239,971 | B1 * | 5/2001 | Yu et al. | 361/695 |
| 6,668,695 | B2 * | 12/2003 | Poole et al. | 83/466 |
| 6,707,668 | B2 * | 3/2004 | Huang | 361/679.48 |
| 6,781,833 | B2 * | 8/2004 | Lu | 361/695 |
| 6,890,138 | B1 * | 5/2005 | Myrick | 410/94 |
| 7,032,872 | B2 * | 4/2006 | Sullivan | 248/346.07 |
| 7,611,112 | B2 * | 11/2009 | Lin | 248/274.1 |
| 7,823,844 | B2 * | 11/2010 | Carnevali | 248/176.1 |
| 7,966,949 | B2 * | 6/2011 | Willey | 108/44 |
| 2007/0034753 | A1 * | 2/2007 | Lee | 248/121 |
| 2007/0131825 | A1 * | 6/2007 | Skrodzki | 248/177.1 |

* cited by examiner

*Primary Examiner* — Allen Flanigan
(74) *Attorney, Agent, or Firm* — Suiter Swantz pc llo

(57) ABSTRACT

An apparatus for mounting a mobile information handling device, comprising a mount for mounting the mobile information handling device, at least one cooling assembly coupled to the mount and suitable for cooling a mobile information handling device mounted on the mount, and a plurality of stabilization assemblies suitable for stabilizing the mobile information handling system mounted on the mount. The apparatus for mounting a mobile information handling device further comprises a dock connecting assembly suitable for providing docking of a peripheral device.

14 Claims, 27 Drawing Sheets

SYSTEM AND APPARATUS FOR MOBILE INFORMATION HANDLING

CROSS REFERENCE TO RELATED APPLICATIONS

The present application is a continuation-in-part under 35 U.S.C. §120 of U.S. patent application Ser. No. 11/401,111, filed Apr. 10, 2006 now U.S. Pat. No. 7,997,819, which in turn claims the benefit under 35 U.S.C. §119(e) of U.S. Provisional Application Ser. No. 60/669,619, filed Apr. 8, 2005, both of which are herein incorporated by reference in their entirety. The present application also claims priority under 35 U.S.C. §119(e) to U.S. Provisional Application Ser. No. 60/851,253 filed Oct. 12, 2006. U.S. Provisional Application Ser. No. 60/851,253 filed Oct. 12, 2006 is hereby incorporated by reference in its entirety.

FIELD OF THE INVENTION

The present invention relates generally to the field of mounting systems and more particularly to a mobile information handling system and apparatus.

BACKGROUND

Delivery and inventory verification is an important aspect of intrastate, interstate and international commerce. For instance, industries such as warehousing, manufacturing, healthcare, and hospitality rely heavily upon prompt and accurate transport and delivery of goods. As such, providing efficient delivery of goods and maintaining accurate records of shipments and inventory are crucial elements in the delivery process. Delivery and inventory verification systems are typically paper-based, often requiring manual processing of deliveries and on-site verification of available inventory. Sales personnel must usually return to a warehouse, loading station, or central office and complete the required delivery paperwork for processing. Following completion of the paperwork, a truck-build for a subsequent delivery must usually be constructed by next-shift employees, creating a significant time lapse between order acquisition and delivery of desired goods. Disadvantageously, delivery personnel may not be operating at maximum efficiency, due the numerous constraints of such a paper based system. Further, this operating inefficiency may prevent delivering parties from complying with supplier directives and mandates, resulting in customer dissatisfaction, and potential lost sales and revenue.

As technological advances are made in mobile communications technologies, it is often desirable for delivery personnel to transport communication and computing devices to and from delivery sites. These devices may aid in streamlining the delivery process by reducing access time to pertinent delivery information and reducing the amount of paperwork delivery personnel must transport. However, these portable communications and computing devices, that may be relatively expensive, may be subject to significant wear and tear due to their daily usage by delivery personnel. Additionally, a certain amount of paperwork is generally necessary for deliveries, whether required by a shipper, a delivery receiver, or other such mandate. Such paperwork is typically generated prior to dispatching a delivery. Disadvantageously, any changes needing to be made to delivery paperwork must be done manually, and may result in illegible modifications and inaccurate paperwork.

Consequently, it would be advantageous if a system and apparatus existed that provided mobile computing based sales force automation, providing efficient delivery of products and associated services to customers who have stringent requirements for their mobile computing systems.

SUMMARY OF THE INVENTION

Accordingly, the present invention is directed to a novel system and apparatus for mobile information handling.

According to a first embodiment of the present invention, a mobile information handling mounting apparatus mount comprises a plurality of cooling assemblies configured to provide cooling of mobile information handling device components.

According to an additional embodiment of the present invention, a mobile information handling mounting apparatus mount comprises a docking module configured to provide docking of a mobile information handling device within the mount.

BRIEF DESCRIPTION OF THE DRAWINGS

The numerous objects and advantages of the present invention may be better understood by those skilled in the art by reference to the accompanying figures in which.

DESCRIPTION OF THE INVENTION

Reference will now be made in detail to presently preferred embodiments of the invention, examples of which are illustrated in the accompanying drawings.

Figure 1:
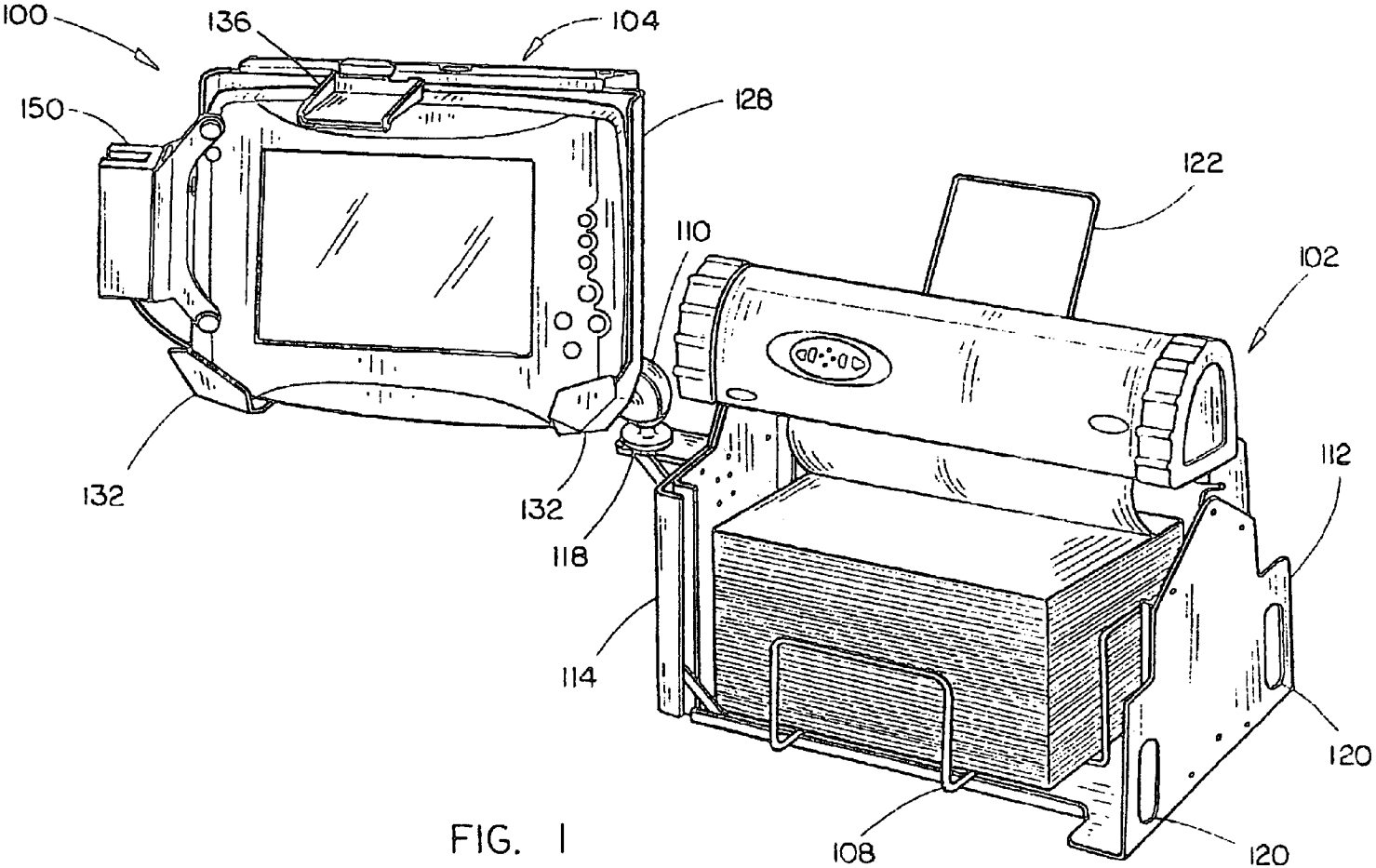
FIG. 1 is an isometric view of a system illustrating an information handling device and printing device positioned within a mounting apparatus in accordance with an exemplary embodiment of the present invention.
Figure 2:
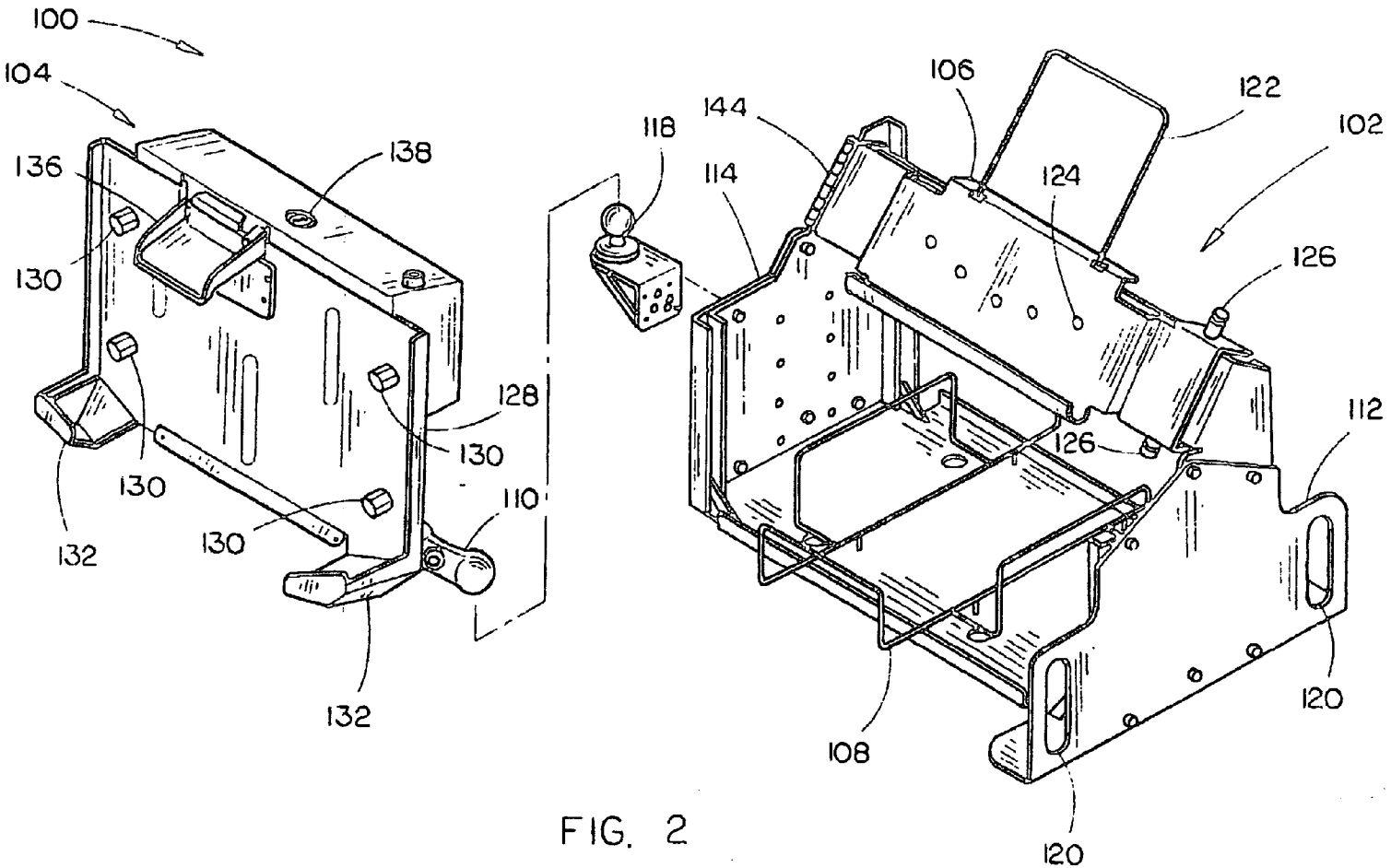
FIG. 2 is an isometric view illustrating the components of a mounting apparatus in accordance with an embodiment of the present invention, such as the embodiment shown in FIG. 1.

Referring to FIGS. 1 and 2, isometric views of a system illustrating an information handling device and printing device positioned within a mounting apparatus 100 and the individual components of the mounting apparatus in accordance with an exemplary embodiment of the present invention are shown. Mounting apparatus 100 may be substantially comprised of a frame assembly 102, a mount 104 for mounting a portable information handling device and a support 106 for supporting a printing device. Mounting apparatus 100 components may be substantially comprised of a combination of durable metals such as a metal alloy including steel, reinforced steel, galvanized steel or a like iron alloy suitable for resisting degradation, magnesium, polycarbonate or like polymeric material, or any material suitable for providing the requisite strength and lightweight properties that may be desired by a user. Referring specifically to FIG. 1, it is further contemplated that an apparatus in accordance with the present invention may be implemented in a mobile information handling system. While FIG. 1 shows a mounting apparatus 100 implemented with a tablet PC, it should be noted that any mobile information handling device may be mounted on mounting apparatus, including a cellular telephone, a personal digital assistant (PDA), a conventional laptop computer and like information handling devices. Implementing any of these devices with a mounting apparatus of the present invention may be accomplished with alternatively sized mounts custom fit to receive a specific device, or a universal mount adjustable to receiving the contemplated devices. Additionally, the system may be flexible to adjust a plurality of angles and positions within a transportation vehicle. Advantageously, the plurality of repositioning options may provide increased user efficiency, making it easier for a driver to operate a mobile information handling device, view the printed output of the printing device, tear off invoices and like functions.

Figure 3:
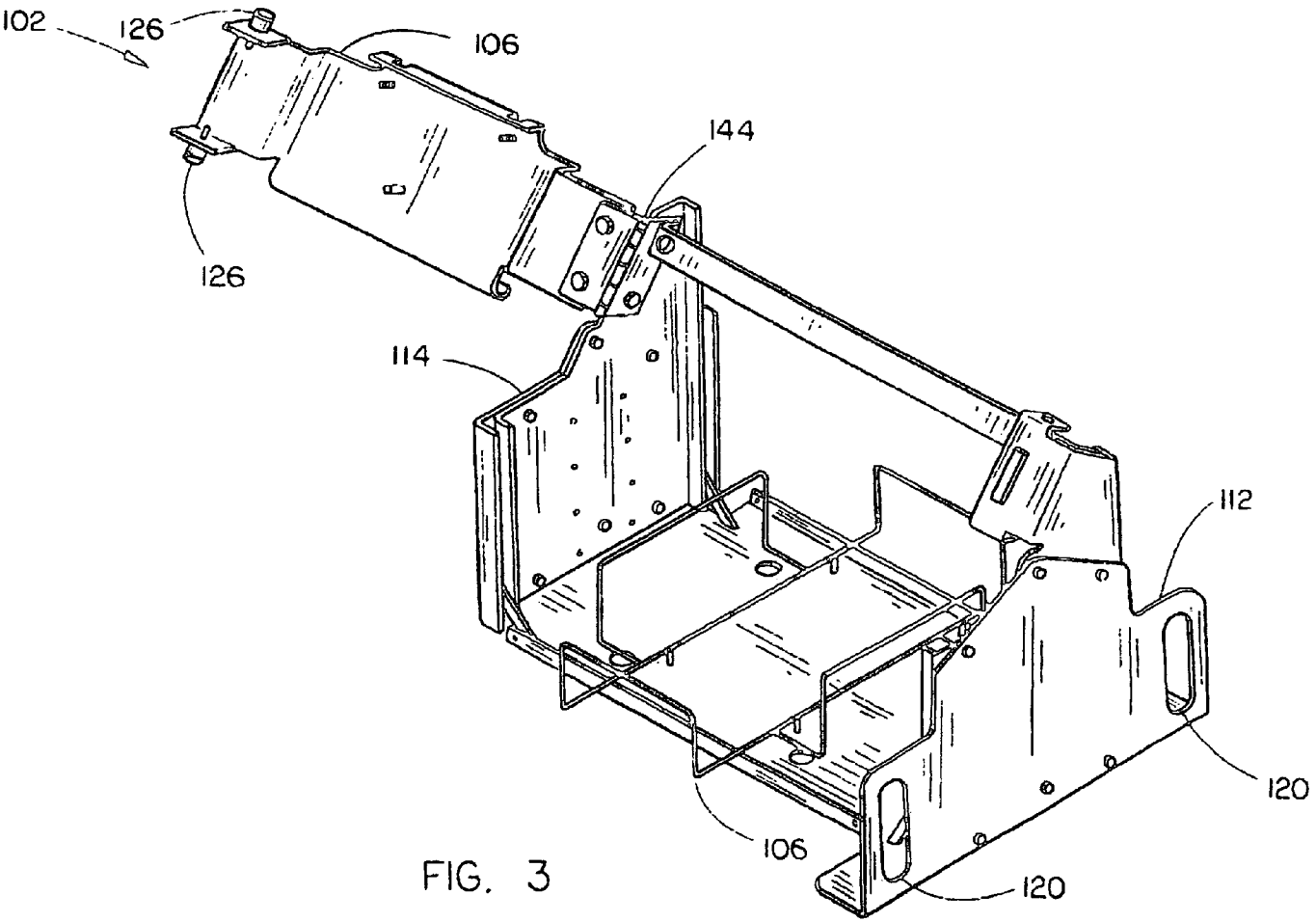
FIG. 3 is an isometric view of a support frame assembly of a mounting apparatus in accordance with an embodiment of the present invention.
Figure 4:
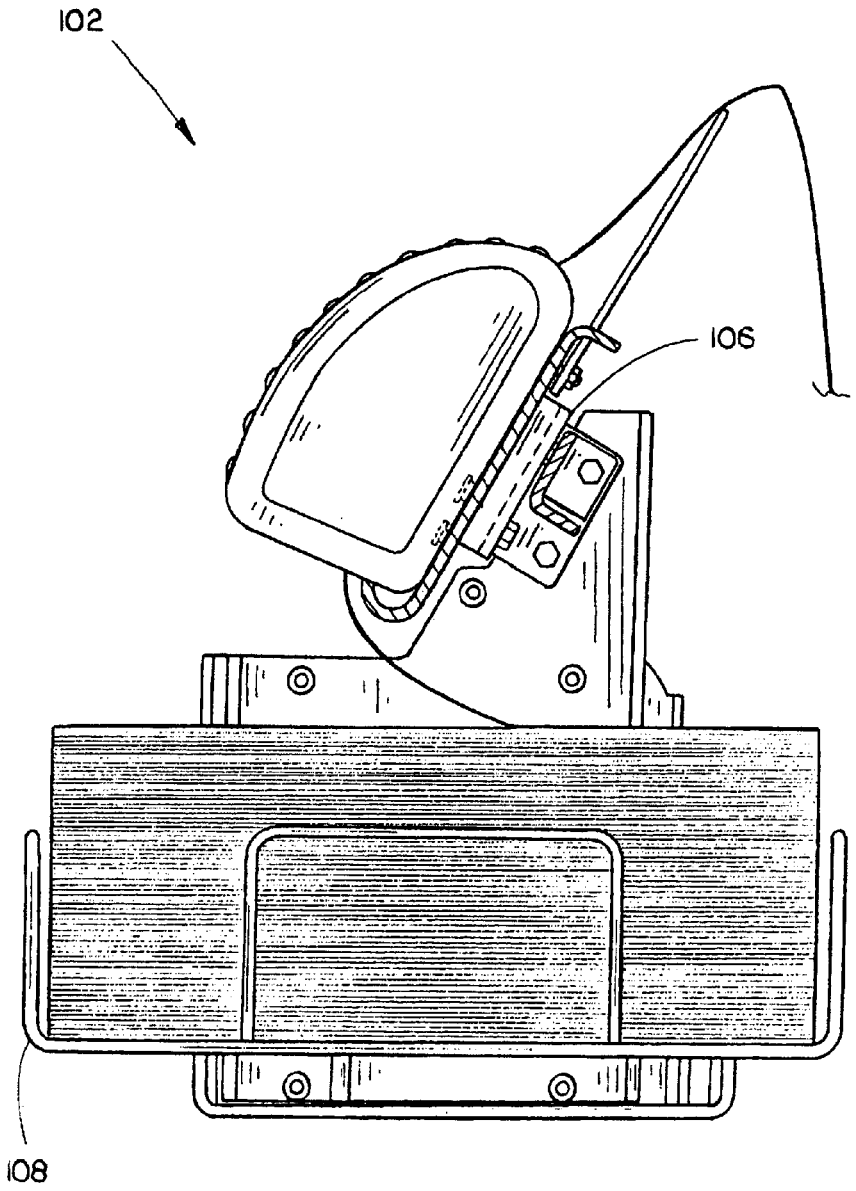
FIG. 4 is a side plan view illustrating a printing device positioned within a support frame assembly of a mounting apparatus in accordance with an embodiment of the present invention.

Referring to FIG. 3, an isometric view of a support frame assembly 102 of a mounting apparatus 100 in accordance with an embodiment of the present invention is shown. Mounting apparatus frame assembly 102 may be substantially comprised of a base support plate, and two or more vertical support plates. Frame assembly 102 may be further comprised of a printable media supply housing such as a basket assembly 108. Basket assembly 108 may be generally comprised of two or more wire frame components that may be bent to form right angles and coupled together at the centers of the wire frame components, substantially forming the shape of a square, rectangle, or a like shape suitable for receiving a supply of printable media such as a box of paper. Basket assembly shape may be adjustable by a user and may be customized for any desired shape. Customization may ensure a supply of printable media is secure within the basket assembly to reduce shifting. Additionally, basket assembly 108 may include one or more wire frame components suitable for fitting across the top of a supply of printable media. Top wire frame components may provide additional securing means for a supply of printable media for securing the media during transportation, particularly during situations when a vehicle encounters uneven terrain, a speed bump or like deviations from relatively smooth motion.

Support frame assembly 102 may be further comprised of two or more side bracket supports 112, 114 for providing elevation and support of printing device support. Side bracket supports 112, 114 may be implemented with stiffening bends for stabilization. Side bracket supports 112, 114 may be comprised of a plurality of apertures, each suitable for receiving a fastener such as a threaded nut. One or more threaded nuts may be substantially imbedded in a side bracket support 112, 114. Imbedded threaded nuts may be suitable for receiving a mating fastener such as a screw or bolt, and may provide a plurality of coupling options for a mounting arm universal ball joint 118. It is contemplated that a universal ball joint 118 may be coupled to a side bracket support 114. Universal ball joint may also be coupled with a mounting arm 110 for coupling the support frame assembly 102 to the mount 104.

To provide further stabilization of a mounting apparatus 100, support frame assembly 102 may include at least one slot 120 for receiving a seatbelt of a seat within a vehicle for securing the mounting apparatus to the seat. Additionally, a layer of shock insulating material such as foam or other such cushioning material may be coupled to the underside of the support frame assembly, between the support and printing device, or between the mounting and mobile information handling device to reduce vibration and movement. It is further contemplated that the front of the printing device support may be secured with bungee cord, nylon straps, or one or more hand formable metal outrigger rods.

Mounting apparatus support frame assembly 102 may be height adjustable. Specifically, the height of the support positioned over the supply of printable media is adjustable between at least a lower height for accommodating a supply of printable media having a first number of pages of printable media and a higher height for accommodating a supply of printable media having a second number of pages of printable media. Height adjustment may be desirable for providing additional volume below the support. Additional volume may allow increased printable media supply to be inserted and housed in basket assembly. For example, mounting apparatus support frame assembly may provide multiple orientations, providing a variable volume of space between support and base support plate of mounting apparatus 100. One orientation may accommodate a 6" supply of printable media, another may accommodate a 12" supply of printable media, and the like.

Support may further include a printable media guide 122 suitable for providing a plurality of guided output orientations. Guided output orientations may prevent printed media exiting the printing device from falling back into the media supply box and potentially getting pulled back into printing device, causing a printing device jam. A straight output orientation may allow viewing of printout page closest to printing device. Bent version may allow printout page to fall back as it exits the printing device. This option may be utilized when view height is limited to prevent obstructed viewing of a passenger side mirror.

Figure 5:
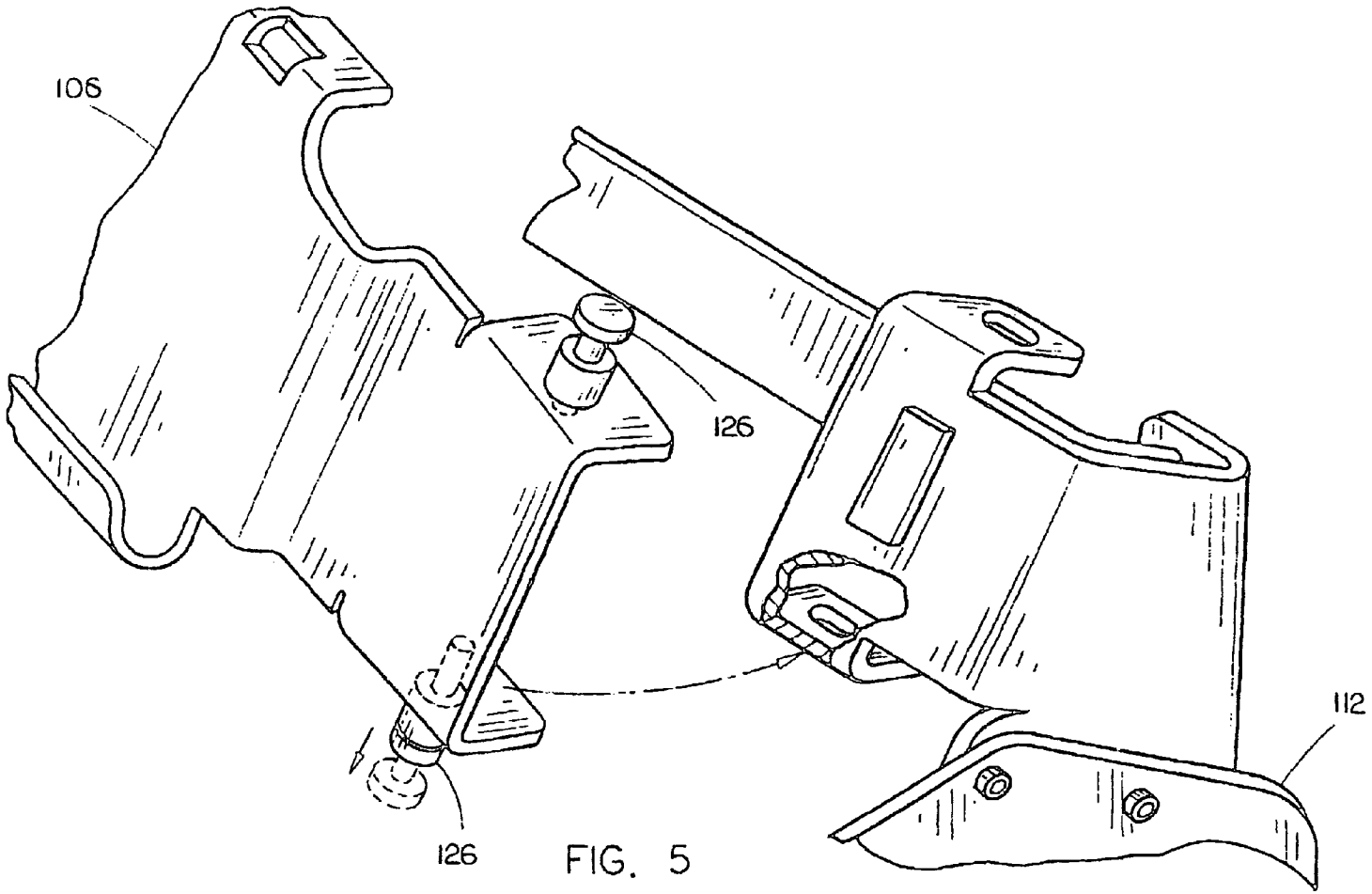
FIG. 5 is an exploded view illustrating a latching mechanism of a frame assembly of a mounting apparatus in accordance with an embodiment of the present invention.
Figure 6:
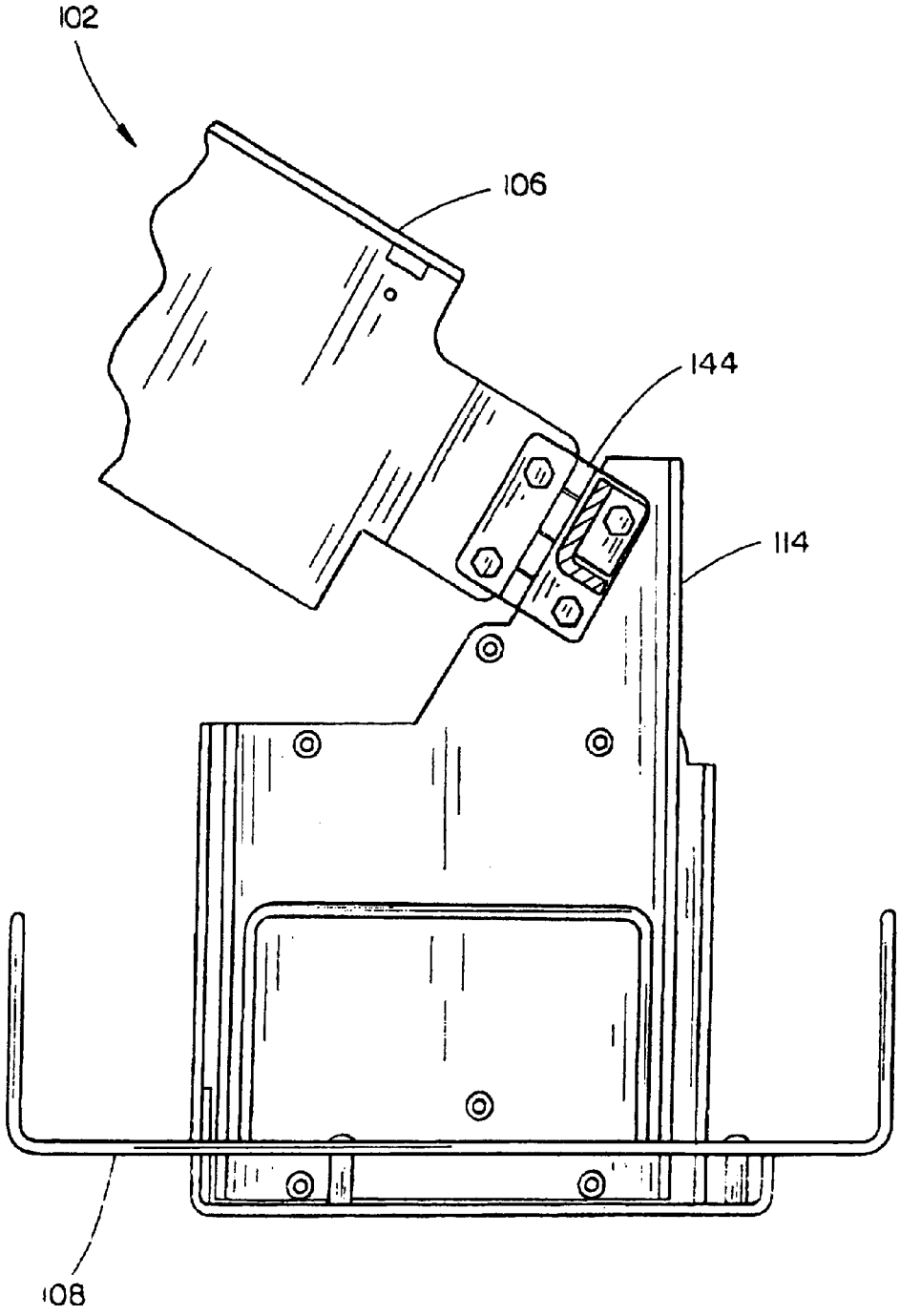
FIG. 6 is a side plan view of a support frame assembly of a mounting apparatus in accordance with an embodiment of the present invention.

A support 106 may be mounted to the support frame assembly for supporting a printing device. Support 10 may be substantially comprised of a front plate having at least one fastener 124 suitable for receiving a mating fastener coupled to a printing device for securing the printing device to the support. The support 106 may be pivotally coupled to the frame assembly 102 for allowing a printing device to be rotated between a first position and a second position. In one embodiment, the printing device may be positioned over the supply of printable media. However, it may be desirable to provide and a second position, for instance, positioning the printing device substantially away from the frame assembly 102 for allowing insertion of printable media into the basket assembly 108. One end of the support 106 may be rotatably coupled to the frame assembly 102. For example, support end may be coupled to a side support bracket 114 with a hinge mechanism 144. An opposite support end may be removably coupled to the frame assembly 102. Removable coupling may provide release of support end to allow access to an interior portion of the support frame assembly 102. In one embodiment, removable coupling of a support end to a frame assembly 102 may be accomplished via one or more plunge latch mechanisms 126. Referring to FIG. 5, an exploded view illustrating a plunge latch mechanism 126 of a frame assembly 102 of a mounting apparatus 100 in accordance with an embodiment of the present invention is shown. When a support 106 is positioned substantially over a supply of printable media, plunge latch mechanism 126 may be inserted through a receiving aperture located on the frame assembly 102. Plunge latch mechanism may spring loaded, and may be pulled in a direction substantially away from the support 106 such that the mechanism is no longer inserted through a receiving aperture. Support 106 may then be rotated outward to allow access to an interior portion of the frame assembly. It is further contemplated that one or more support ends may be removably coupled to the support frame assembly 102 utilizing any mechanism for partially or completely securing and unsecuring the support 106 to and from the frame assembly 102.

Figure 7:
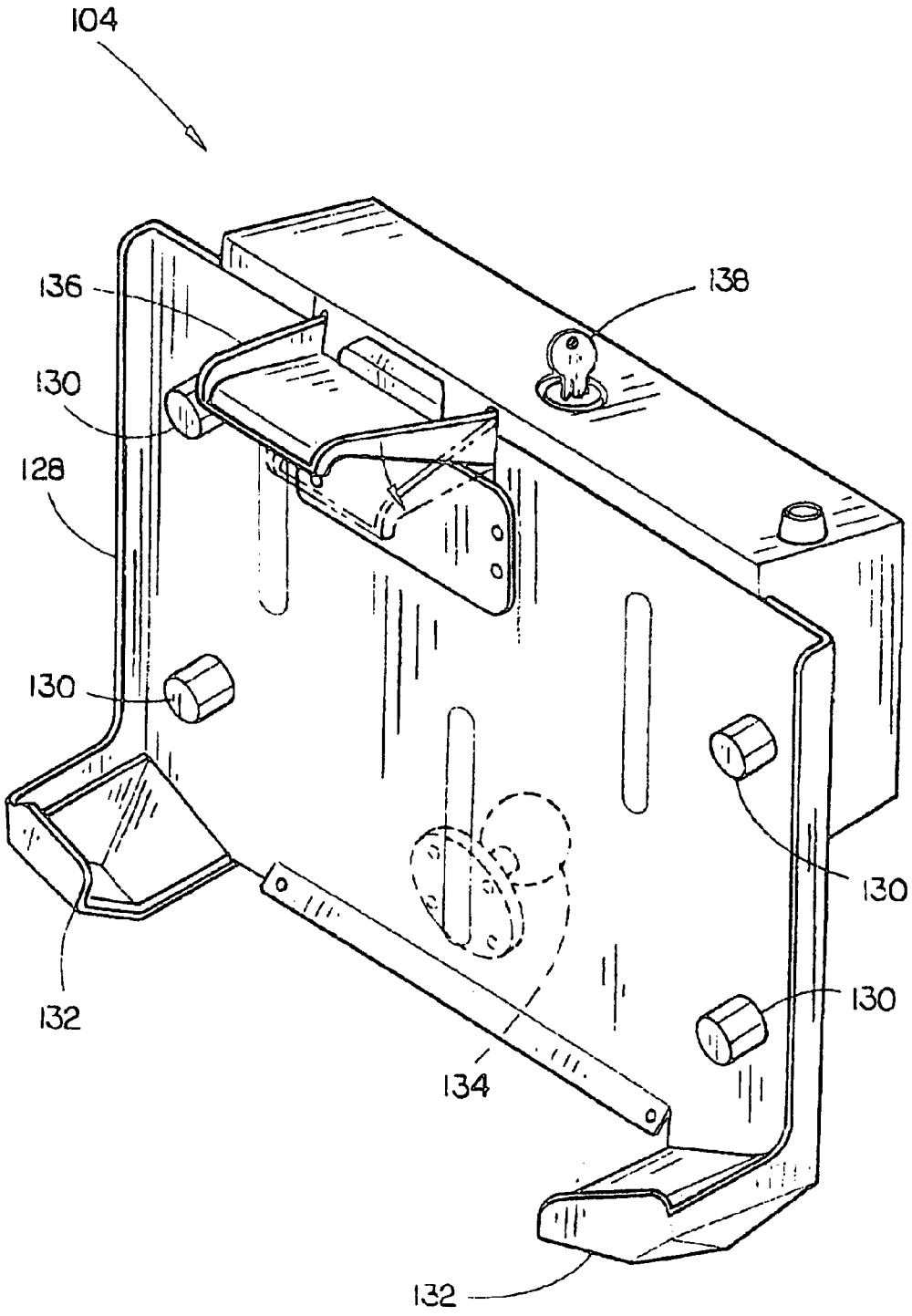
FIG. 7 is an isometric view of a mount of a mounting apparatus in accordance with an embodiment of the present invention.
Figure 8:
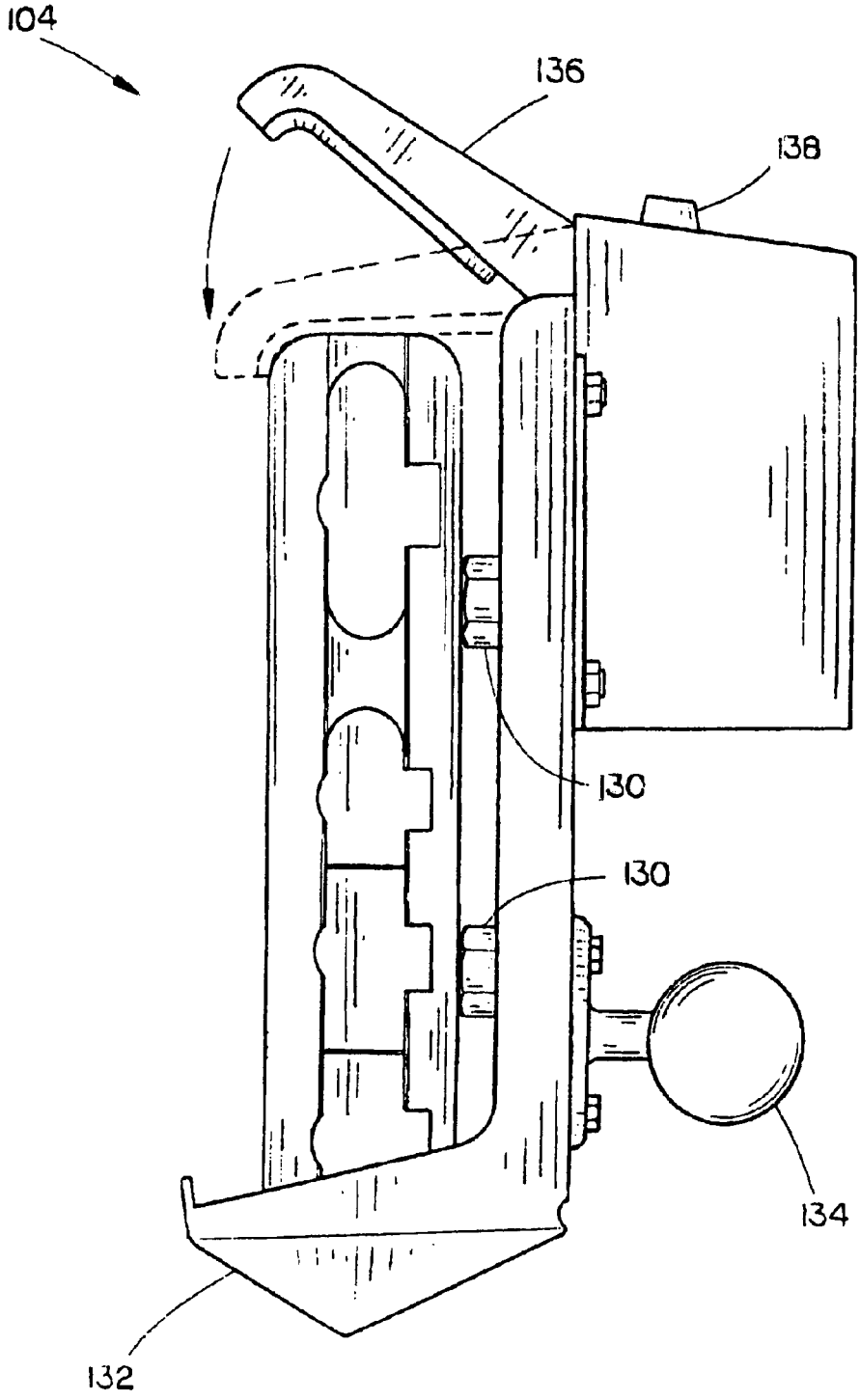
FIG. 8 is a side view of a mount of a mounting apparatus in accordance with an embodiment of the present invention.

Referring to FIGS. 7 and 8, isometric and side views of a mount 104 for mounting a mobile information handling device that may be implemented with a mounting apparatus 100 in accordance with an embodiment of the present invention are shown. Mounting apparatus mount 104 may be substantially comprised of a dock 128 for docking the mobile information handling device and a mounting arm 110 for coupling the dock 128 to the frame assembly 102. The mounting arm 110 may allow the dock 128 to be moved in three dimensions for positioning a mobile information handling device with respect to the frame assembly 102.

Dock 128 may be substantially comprised of plurality of raised elements 130 disposed on a front surface of the dock for supporting a mobile information handling device, at least one corner support plate 132 suitable for receiving a corner of an information handing device and universal ball joint 134 coupled to a rear surface of a dock 128. Mount 104 may allow one-handed removal of information handling device. Mounting plate may include a channel insert for inserting an information handling device operating instrument such as a stylus. Incorporated operating instrument holder incorporated may allow easier access to an operating instrument while a mobile information handling device is mounted to the mount 104. Mount 104 may be further comprised of a latch assembly securing mechanism 136. Mount latch assembly 136 may be implemented with a lock and key assembly 138 for securing a latch in place or releasing the latch for removal or insertion of an information handling device. Latch assembly securing mechanism 136 may be adjustable, and may secure a mobile information handling device to the mount 104 whether or not the device is encased in a protective housing. It is contemplated that a mobile information handling device may include a carrying case for at least partially encasing the mobile information handling device. Mount 104 may accommodate a mobile information handling device encased in a protective housing such as a carrying case, sleeve, or other such encasing suitable for protecting the information handling device from elements such as weather, excessive handling and like causes of device wear and tear. To accomplish such adjustable accommodation of an information handling device, the latch assembly 136 may be adjustable for securing the mobile information handling device in the dock while placed in the carrying case or while not placed in the carrying case. Specifically, the latch assembly may be pivotably anchored to mount 104. Latch assembly 136 may pivot to a desired orientation, and may be secured at the orientation via the lock and key assembly 138.

Figure 9:
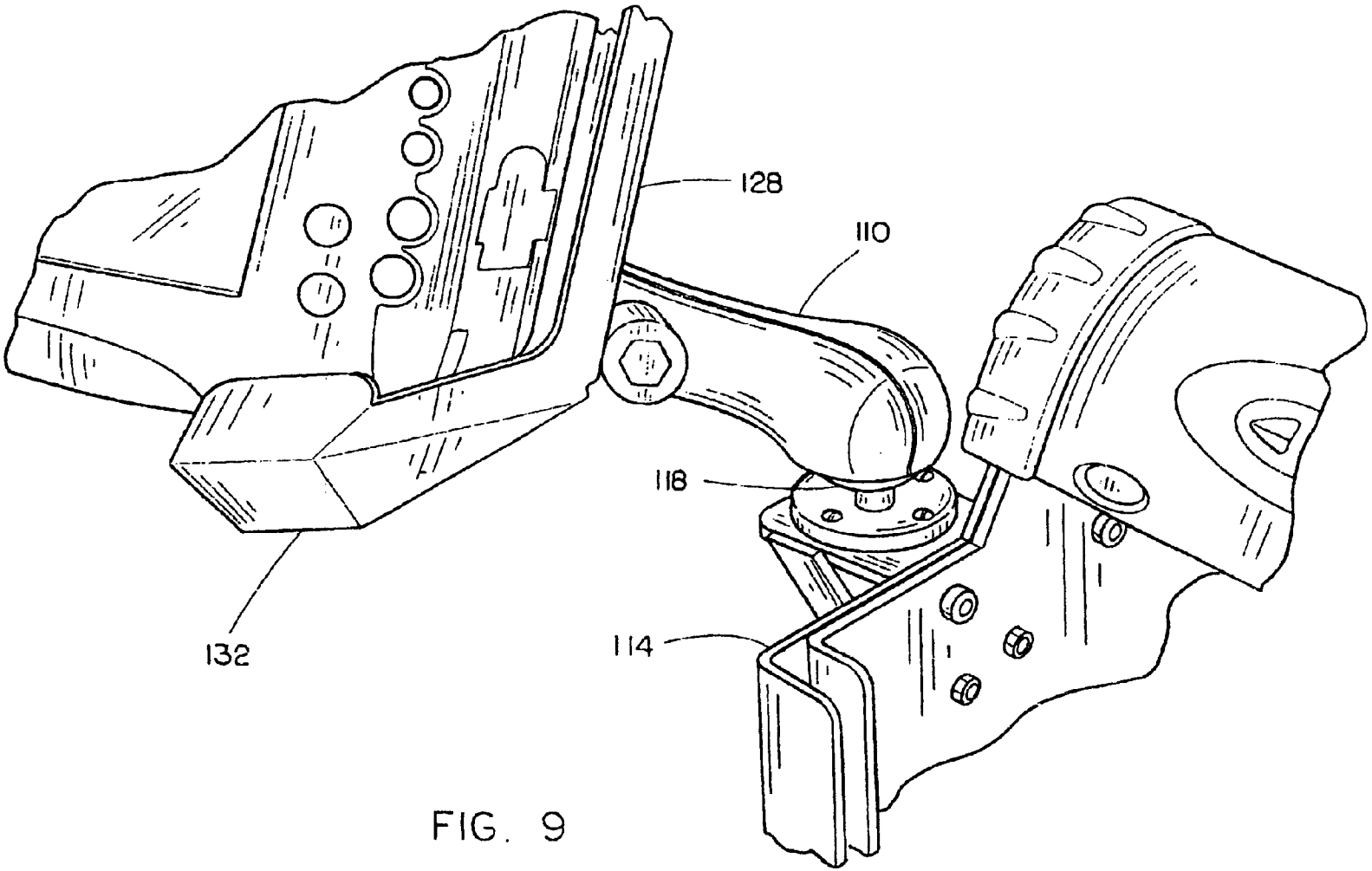
FIG. 9 is an exploded view of a mounting arm coupling a mount and a support frame assembly of a mounting apparatus in accordance with an embodiment of the present invention.

Mounting apparatus may be further comprised of a mounting arm 110 coupling the mount to the frame assembly. Referring to FIG. 9, an exploded view of a mounting arm 100 coupling a mount 104 and a support frame assembly 102 of a mounting apparatus 100 in accordance with an embodiment of the present invention is shown. The mounting arm 110 may be suited to receive at least one universal ball joint about which at least one of the mounting arm 100 and mount 104 may rotate during positioning of the mobile information handling device.

It is further contemplated that one or more mounting apparatus components may include a power adapter for providing electrical power to the mobile information handling device or printing device while the mobile information handling device or printing device is mounted to the mounting apparatus 100. For example, power adapter may be a DC power adapter docking connection for charging a mobile information handling device while docked in the dock. Mobile information handling device may be implemented with a PCB adapter having exposed surface contacts and spring finger contacts. It is further contemplated that mobile information handling system may be integrated with additional docking capabilities. For example, system may include a serial connection and wireless connectivity capabilities with Bluetooth or 802.11b technologies.

A mounting apparatus 100 in accordance with the present invention may include additional peripheral accessories for improving utility and function. For example, mounting apparatus 100 may include a mounting bracket and ball mount having multiple orientations and locations. In one embodiment, mounting bracket and ball mount system may include two locations, such as one location on a base side and one location on hinge side bracket. This may be an ideal positioning of these mounting apparatus components when the mounting apparatus is in an upper most orientation. Mounting apparatus may further include a shock mount adapter plate. Shock mount adapter plate may be utilized if a printing device mount requires mounting on an elevated platform such as a pedestal. Shock mount adapter place may absorb increased shock to the mounting apparatus 100 from the potentially less stable elevated environment.

Figure 10B:
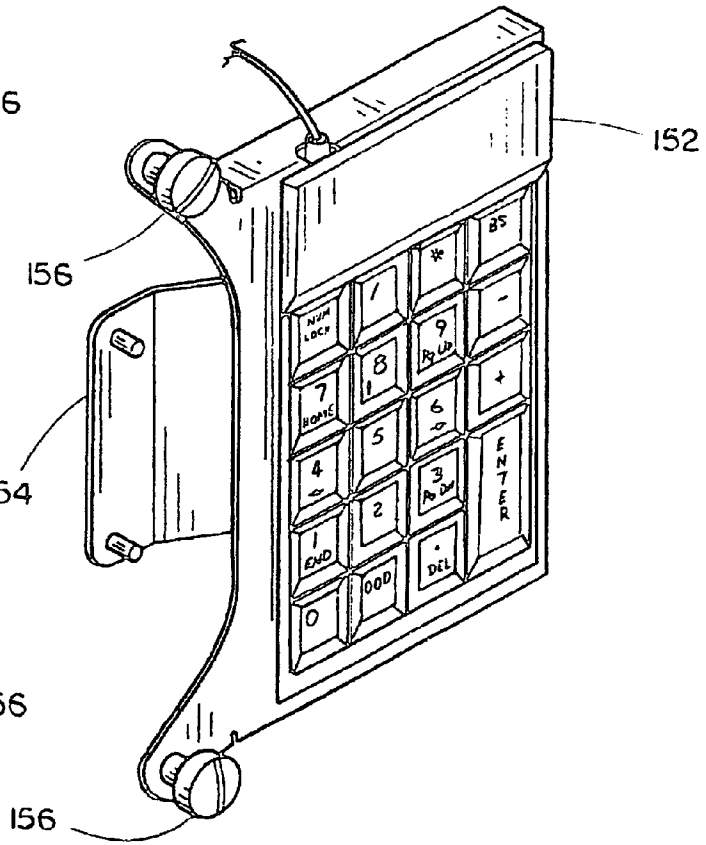
FIGS. 10A and 10B are isometric views of a magnetic card reader and a numeric keypad that may be mountable onto an information handling device positioned within a mounting apparatus in accordance with an embodiment of the present invention.
Figure 10A:
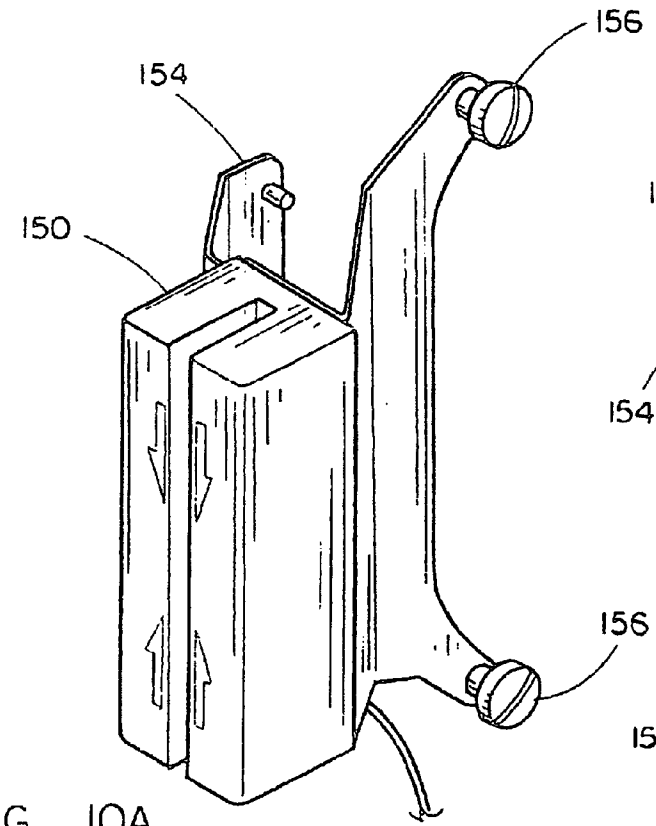
Figure 11:
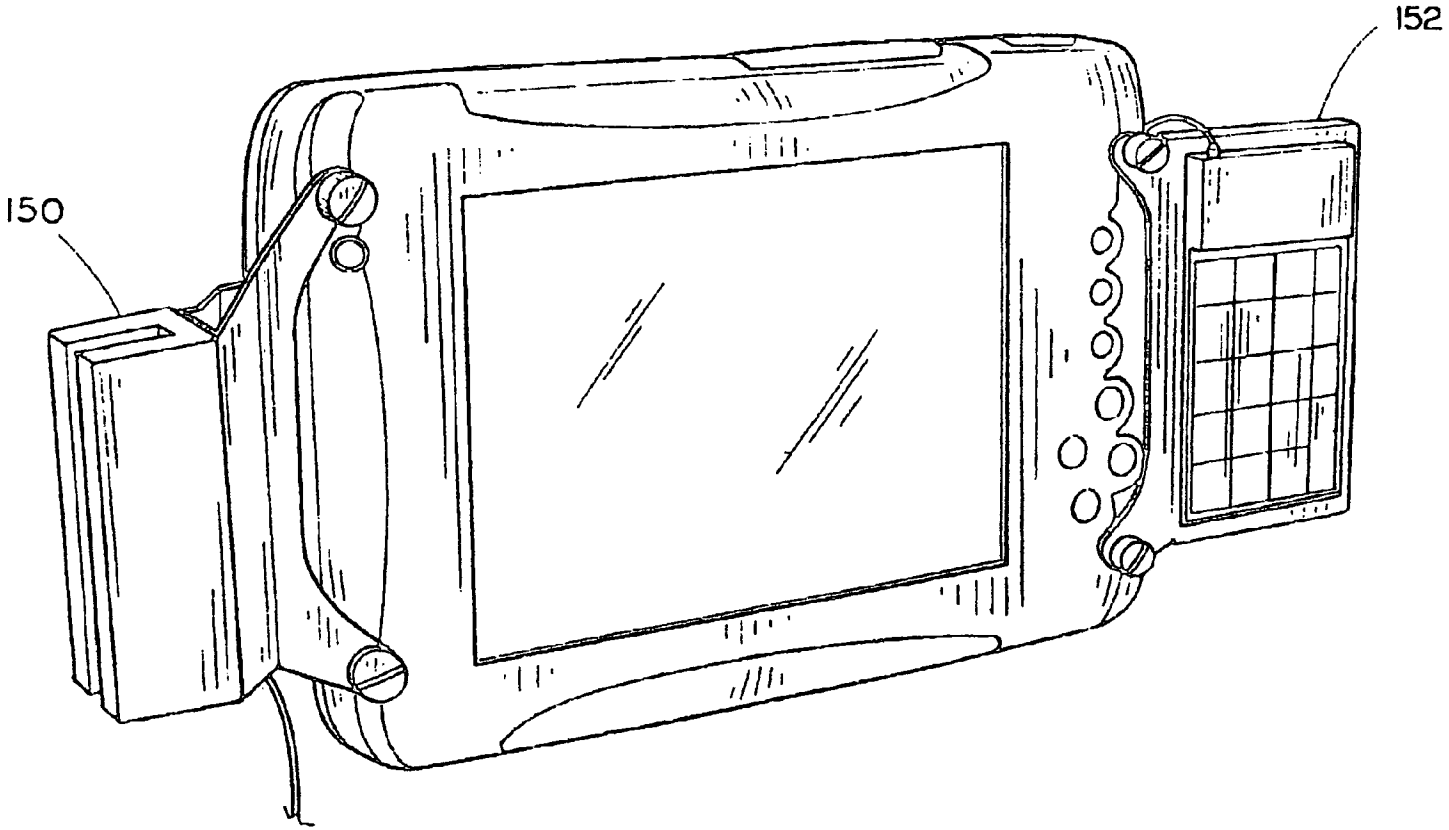
FIG. 11 is an isometric view of a magnetic card reader and numeric keypad mounted onto an information handling device in accordance with an embodiment of the present invention.
Figure 12:
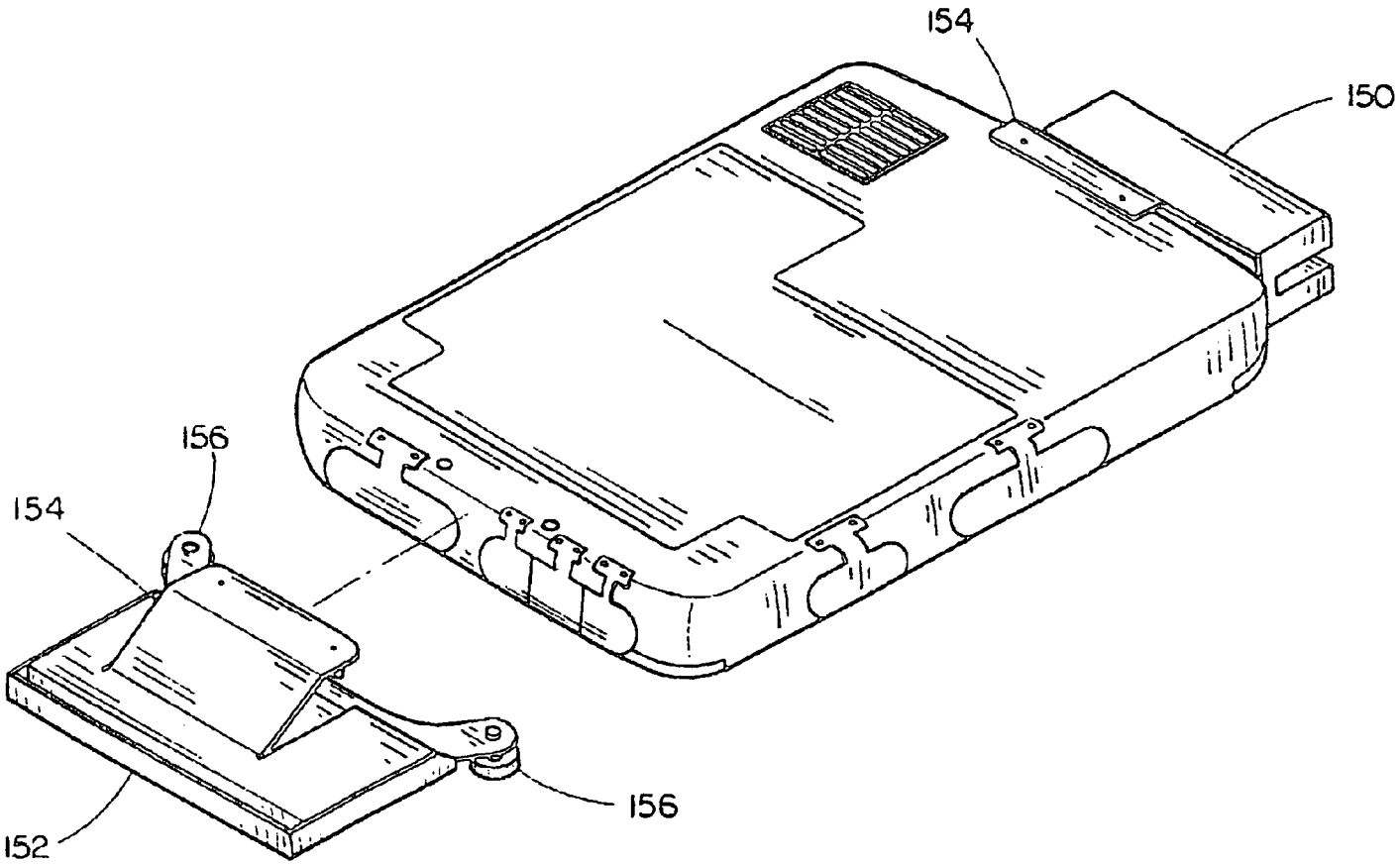
FIG. 12 is a back view of a magnetic card reader and numeric keypad mounted onto an information handling device in accordance with an embodiment of the present invention.
Figure 13:
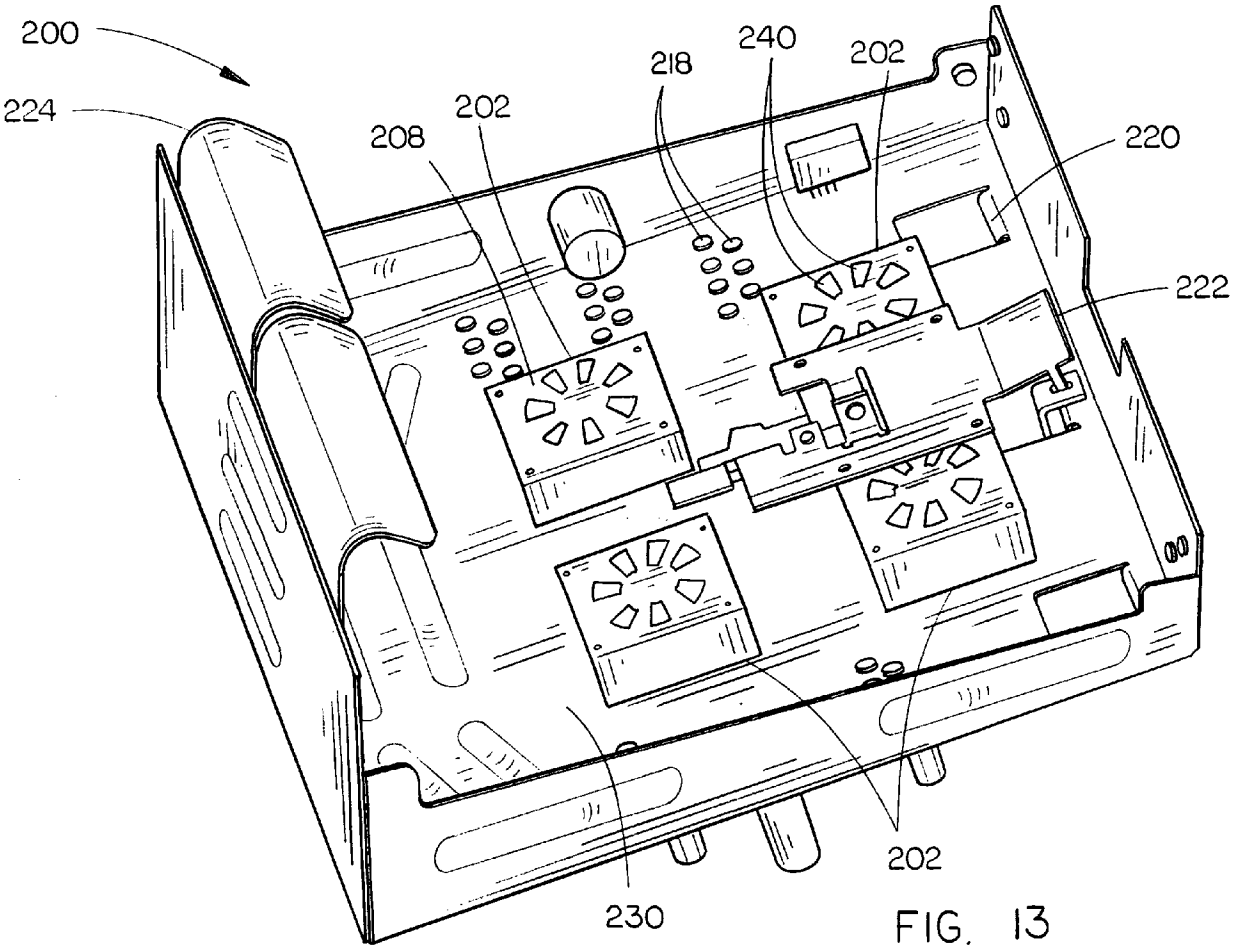
FIG. 13 is an isometric back view of a mounting apparatus comprising a plurality of cooling assemblies in accordance with an embodiment of the present invention.

Referring to FIGS. 10A and 10B, 11 and 12, isometric views of a magnetic card reader 150 and a numeric keypad 152 that may be mountable onto an information handling device positioned within a mounting apparatus 100 in accordance with an embodiment of the present invention are shown. Mobile information handling system may include peripheral computing and communications accessories for increased utility of a mobile information handling device. Peripheral computing and communications accessories may be serially or wirelessly coupled to a mobile information handling device positioned within a mounting apparatus 100 of the present invention. Referring specifically to FIG. 10A, peripheral computing accessories may include a tray assembly substantially comprised of a magnetic card reader 150 coupled to a mounting tray. Referring specifically to FIG. 10B, peripheral computing accessories may include a tray assembly substantially comprised of a numeric keypad 152 coupled to a mounting tray.

Utility of a mobile information handling device may be improved by one or more metal bracket assemblies 154 suitable for enabling mounting of desired peripheral computing or communications accessories. Bracket assembly 154 may provide tool-less mounting of the card reader assembly 150 and numeric key pad tray assembly 152 to the carrying case encasing a mobile information handling device or directly to the mobile information handling device. Bracket assembly 154 may include at least one screw assembly configured to secure tray assembly 154 to a mobile information handling device without inserting the screw assembly into the device. The screw assembly may contact the surface of the device and provide adequate tension to prevent a tray assembly 154 from undesired self-removal from the mobile information handling device. Card reader assembly 150 and keypad assembly 152 may be stably mounted without the need for physical modifications to the mobile information handling device. Configuration of the installed card reader 150 and the installed keypad assembly 152 may also provide a storage area in conjunction with the outer end wall of the computer for excess data cord to be conveniently and securely stored. Position of the card reader assembly 150 with respect to the computer data interconnection allows convenient clearance for the operation of sliding a card through the card reader reading slot.

Referring generally to FIGS. 13-17, illustrations of a cooling mount 200 according to an exemplary embodiment of the present invention are shown. Cooling mount 200 may comprise a plurality of cooling assemblies 202 suitable for cooling a mobile information handling device is shown. Cooling mount 200 may comprise a plurality of cooling assemblies 202 is shown. With specific reference to FIG. 13, an isometric back view of a cooling mount 200 comprising a plurality of cooling assemblies 202 in accordance with an embodiment of the present invention is shown. It is contemplated that a mobile information handling mounting apparatus 100 in accordance with the present invention may be implemented with a cooling mount 200. It is also contemplated that cooling assemblies 202 of cooling mount 200 may be mountable on a mount 104 of mobile information handling mounting apparatus 100 described herein. Further, cooling mount 200 may also be suitable for engagement with a printing device support frame assembly 102 as illustrated in FIGS. 1-6 to provide cooling for a printing device. It is further contemplated that cooling apparatus 200 may comprise the elements of mount 104 as illustrated in FIGS. 7 and 8.

A cooling mount 200 in accordance with an embodiment of the present invention, such as the embodiment illustrated in FIGS. 13-17, may comprise a plurality of cooling assemblies 202 coupled to a back surface of the cooling mount. Plurality of cooling assemblies 202 may provide increased cooling ability, as individual cooling assemblies may cool individual sections of the information handling device. Additionally, cooling assemblies 202 may be positioned to cool specific sections of the mobile information handling device known to generate heat. In additional embodiments, cooling mount 200 may comprise one cooling assembly 202 suitable for cooling a mobile information handling device in its entirety. In this embodiment, the area of the cooling assembly 202 may be sufficiently large so as to encompass a substantial portion of the area of the cooling apparatus 200.

Figure 14:
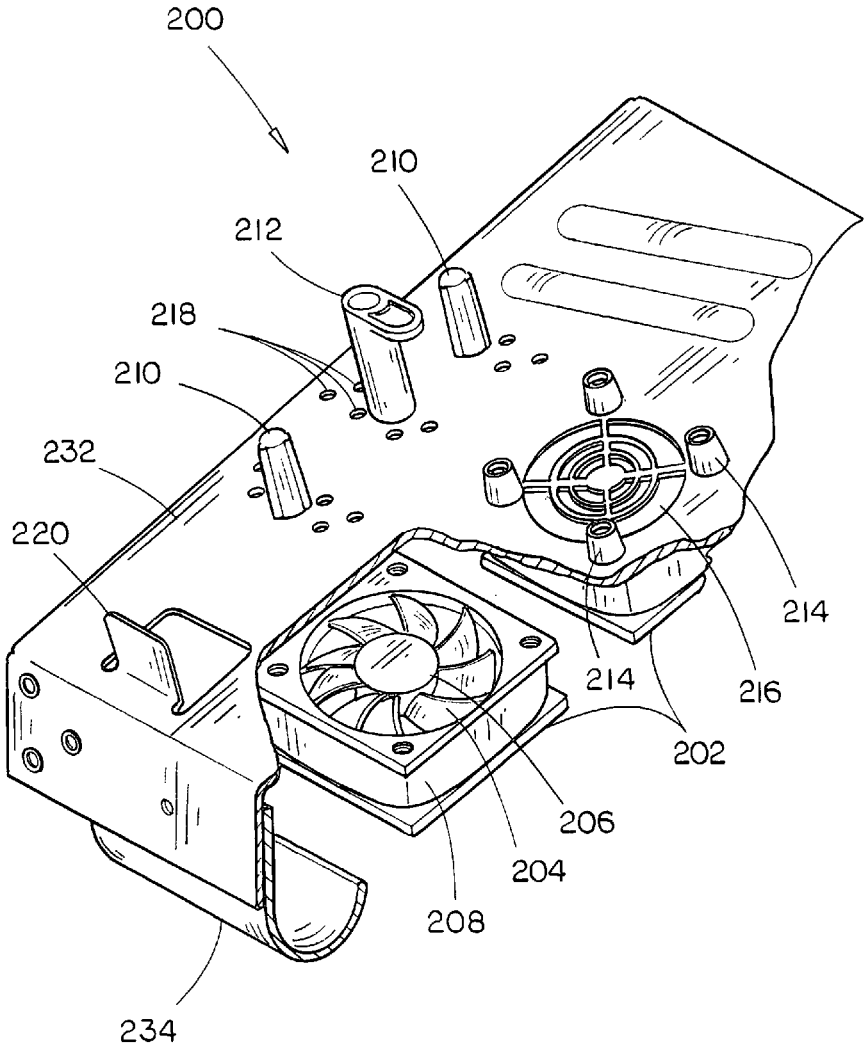
FIG. 14 is a partial cut-away view of a mounting apparatus comprising a plurality of cooling assemblies in accordance with an embodiment of the present invention.

Referring to FIG. 14, a partial cut-away view of a cooling apparatus comprising a plurality of cooling assemblies in accordance with an embodiment of the present invention is shown. Cooling assembly 202 may comprise driving means 206 such as a motor and at least one blade assembly 204 driven by the driving means 206. Blade assembly 204 may be connected to and driven by a driving means 206 such as a motor to rotate and thereby suck in or exhaust air to create airflow effect. In some instances, cooling assembly 202 may comprise a plurality of blades and a frame for receiving the blades therein.

A cooling assembly 202 for cooling an information handling device may be disposed within a housing 208 suitable for receiving at least one blade assembly 204 and drive means 206 and mounting the cooling assembly 202 to the back surface 230 of the cooling mount 200. The housing 208 may prevent objects or debris from entering the cooling assembly 202. The housing 208 may be formed with a plurality of apertures 240 peripherally formed on the housing 208 for allowing air to enter into the housing 208 through the apertures 240, and thereby enhancing air intake and working efficiency of the cooling assembly 202. Cooling assembly housing 208 may be permanently or detachably coupled to a surface of the cooling mount 200. Permanent coupling of a cooling assembly housing 208 to the cooling mount 200 may be in the form of welding, bonding, adhesion, and like methods of permanent coupling. Detachable coupling of cooling assembly housing 208 to the cooling mount 200 may be in the form of securing the cooling assembly housing 208 via a nail, screw, bolt and nut assembly, rail and groove assembly or a like detachable coupling mechanism.

Figure 15:
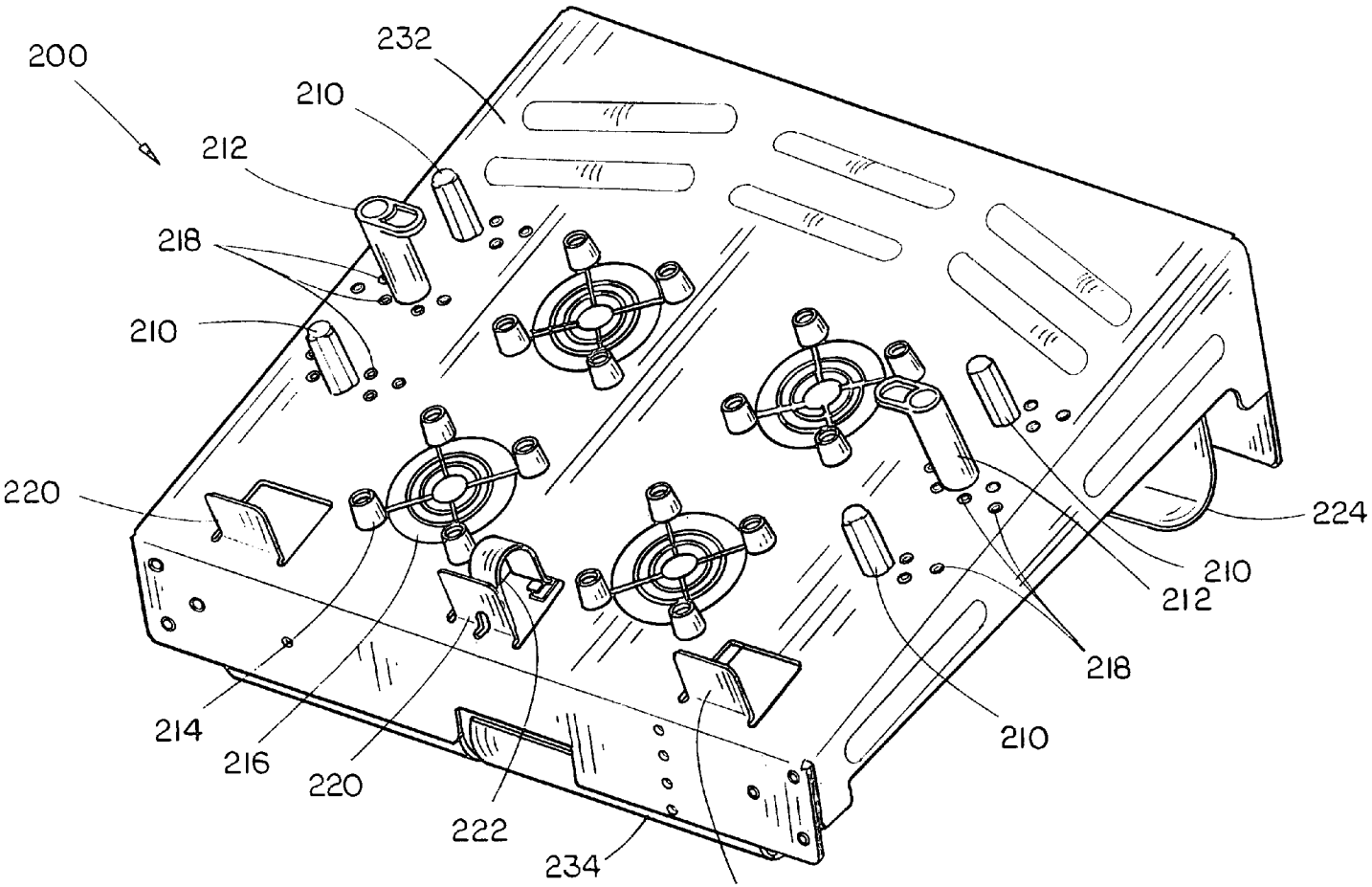
FIG. 15 is a front isometric view of a mounting apparatus comprising a plurality of cooling assemblies in accordance with an embodiment of the present invention.

Referring to FIGS. 14 and 15, cooling mount 200 may comprise a plurality of apertures 216 such as vents shaped to allow airflow through the apertures. Air produced by a cooling assembly 202 may flow through the apertures 216 and cool an information handling device. Apertures 216 formed on the cooling mount 200 may facilitate operation of the cooling assembly 202 by providing flow through for air produced by the cooling assembly 202. Apertures 216 may be a plurality of air-guiding parts are formed on the cooling mount and curve-shaped to comply with a moving direction of airflow. The cooling assembly 202 may be mounted flush against a mount aperture on a back surface 230 of the cooling mount 200 opposite to the surface 232 upon which the mobile information handling device is mounted. In this configuration, airflow produced by cooling assembly 202 may flow through the apertures 216 in a direction that is substantially perpendicular, or otherwise orthogonal, with the apertures 216.

With continued reference to FIGS. 14 and 15, cooling mount 200 may further comprise a plurality of spacer elements 214 positioned about the perimeter of the cooling apertures 216. Spacer elements 214 may provide space between the cooling mount 200 and a mobile information handling system. Spacer elements 214 may allow air generated by a cooling assembly 202 to circulate behind the mounted mobile information handling system, thus providing a continuous flow of cooling air to a surface of the mobile information handling system when a cooling assembly 202 is on. Spacer elements 214 may be positioned substantially about the perimeter of the top surface of the mount, where the mobile information handling device may be placed. In one embodiment, spacer elements 214 may be coupled to the mount substantially about the perimeter of the plurality of apertures through which air generated by the cooling assemblies 202 flows.

Cooling mount 200 may further comprise a plurality of stabilization assemblies 210 to stabilize a mobile information handling system mounted on the mount. A stabilization assembly 210 may be a post, stopper, block or a like raised element permanently or releasably coupled to the cooling mount 200 substantially adjacently to a mounted mobile information handling device. Stabilization assembly 210 may minimize or reduce lateral shifting of the mobile information handling device. Cooling mount 200 may comprise a plurality of apertures 218 suitable for mating with a stabilization assembly 210. Apertures 218 may be positioned at various locations on the cooling mount 200 to provide adjustable distance between two or more stabilization assemblies 210, and adjustable depth of insertion of a stabilization assembly 210 and may be of varying size to accommodate stabilization assemblies 210 of varying size.

Cooling mount 200 may comprise at least one mobile information handling device securing assembly 212. Securing assembly 212 may be coupled to the cooling mount 200 along the same vertical axis as the one or more stabilization assemblies 210 to provide additional lateral support for a mobile information handling device mounted on the cooling mount 200. Securing assembly 212 may also comprise a vertical post member suitable for insertion in an aperture on the mount and an elongated horizontal top member suitable for resting substantially on a top surface of the mobile information handling device mounted on the mount. Securing assembly may prevent or substantially reduce dislodging of the mobile information handling device from the cooling mount 200, such as if the cooling mount 200 were turned over, if the cooling mount 200 were being transported in a motor vehicle that traveled over an uneven surface or like circumstances that may cause the mobile information handling device to separate from the cooling mount 200. Securing assembly 212 may also be suitable for providing sufficient downward force on the when coupled to the cooling mount 200 to secure a mobile information handling device in place and prevent or substantially eliminate motion of the mobile information handling device.

Cooling mount 200 may also comprise one or more support ledges 220 suitable for supporting a mobile information handling device mounted on the cooling mount 200. Support ledges 220 may provide upward support for a mobile information handling device mounted on the cooling mount 200. A support ledge may be formed by cutting through a portion of the cooling mount 200, such as cutting out three sides of a rectangle, trapezoid or like four sided figure, two sides of a triangle or like three sided figure, a semicircle, or a portion of any desired shape and bending the cut out shape substantially outward to form a support ledge 220. In an additional embodiment, support ledge 220 may be coupled to the cooling mount 200 in a manner similar to the stabilization assembly or the securing assembly. For instance, cooling mount may comprise one or more apertures, slots or coupling devices suitable for receiving and securing a support ledge 220 or a mating coupling device coupled to the support ledge 220. A support ledge 220 may be suitably wide to allow a bottom edge of the mobile information handling device to rest substantially on the support ledge.

The cooling assembly 202 may be powered via a connection to a main board of a docking station or may be battery operated, or powered via a connection directly to a power source such as an outlet, a car power adapter and the like. Cooling assembly 202 may comprise a switch to power on/off the cooling assembly. It is further contemplated that one or more support ledges 220 may comprise an electro-mechanical switch assembly 222 that may be triggered when a mobile information handling device is placed substantially on the support ledge. Electro-mechanical switch assembly 222 may be suitable for initiating cooling assembly blade movement when a mobile information handling device is set in place. For example, the cooling assembly 202 may be powered via a two wire connection to the main board of the docking station and may be provided with an adapter for cooling a mobile information handling device disposed therein. Electro-mechanical switch assembly 222 may power a cooling assembly 202 and may initiate the powering on of the cooling assembly when the mobile information handling device is resting on the support ledge 220. An additional switch located on a cooling assembly 202 or cooling mount 200 may override the electro-mechanical switch assembly 222 and provide power to the cooling assembly 202 as desired by an operator.

Mount 104 or cooling mount 200 may further comprise an adjustable height support assembly 224, 234 suitable for providing multidimensional height adjustment and support for the cooling mount. Adjustable height support assembly may comprise an upper adjustable height bracket 224 suitable for raising or lowering the top of the cooling mount 200 and a lower adjustable height bracket 234 suitable for raising or lowering the bottom of the cooling mount. Height brackets 224, 234 may provide multi-position adjustability for both a front to back angular adjustment and side to side angular adjustment. Front to back angular adjustment may accommodate, for example, a platform, ground, vehicle seat cushion and like surfaces having varying angles of tilt with respect to an essentially level or horizontal surface. Side to side angular adjustment may allow presentation of the computer at different angles to a user. For example, a user may be sitting in the driver's seat of the vehicle, and require the lateral edge of the mount closest to the user to be lower than the lateral edge farther away. Height brackets 224, 234 may comprise a substantially flat portion having adjustment apertures suitable for coupling to a portion of the cooling mount via removable coupling assemblies such screws, nut and bolt assemblies, pins, spring loaded pins and the like. Height brackets 224, 234 may each also comprise a substantially curved portion suitable for resting on a surface such as car seat, table, floor and the like. Curved portions of the adjustable height brackets 224, 234 may provide a space underneath the cooling mount where a seatbelt, strap, rope, cord, or other securing device may be inserted to further stabilize the cooling mount 200.

Figure 16:
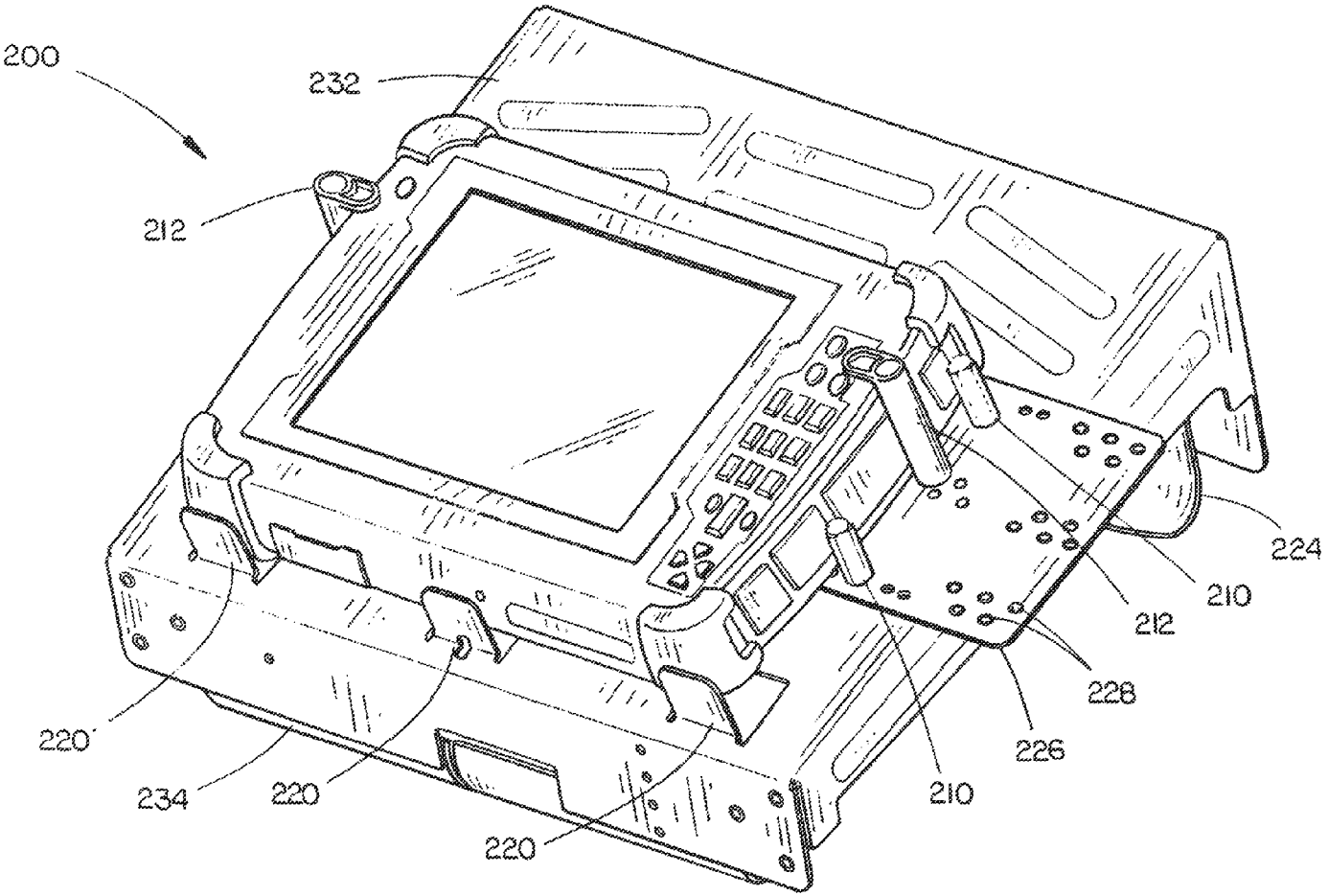
FIG. 16 is a front isometric view of a mounting apparatus in accordance with an embodiment of the present invention.

Referring to FIG. 16, cooling mount 200 may further comprise an attachment support plate 226 suitable for providing support and adjustable placement of attachment auxiliary brackets to hold, for example, peripheral devices such a GPS monitor, a mobile document printer, a cell phone holder, and the like. Attachment support plate 226 may comprise a plurality of apertures 228 suitable for engaging with support posts, securing assemblies, auxiliary bracket assemblies, or like devices having a component suitable for insertion through an attachment support plate aperture 228.

Figure 17:
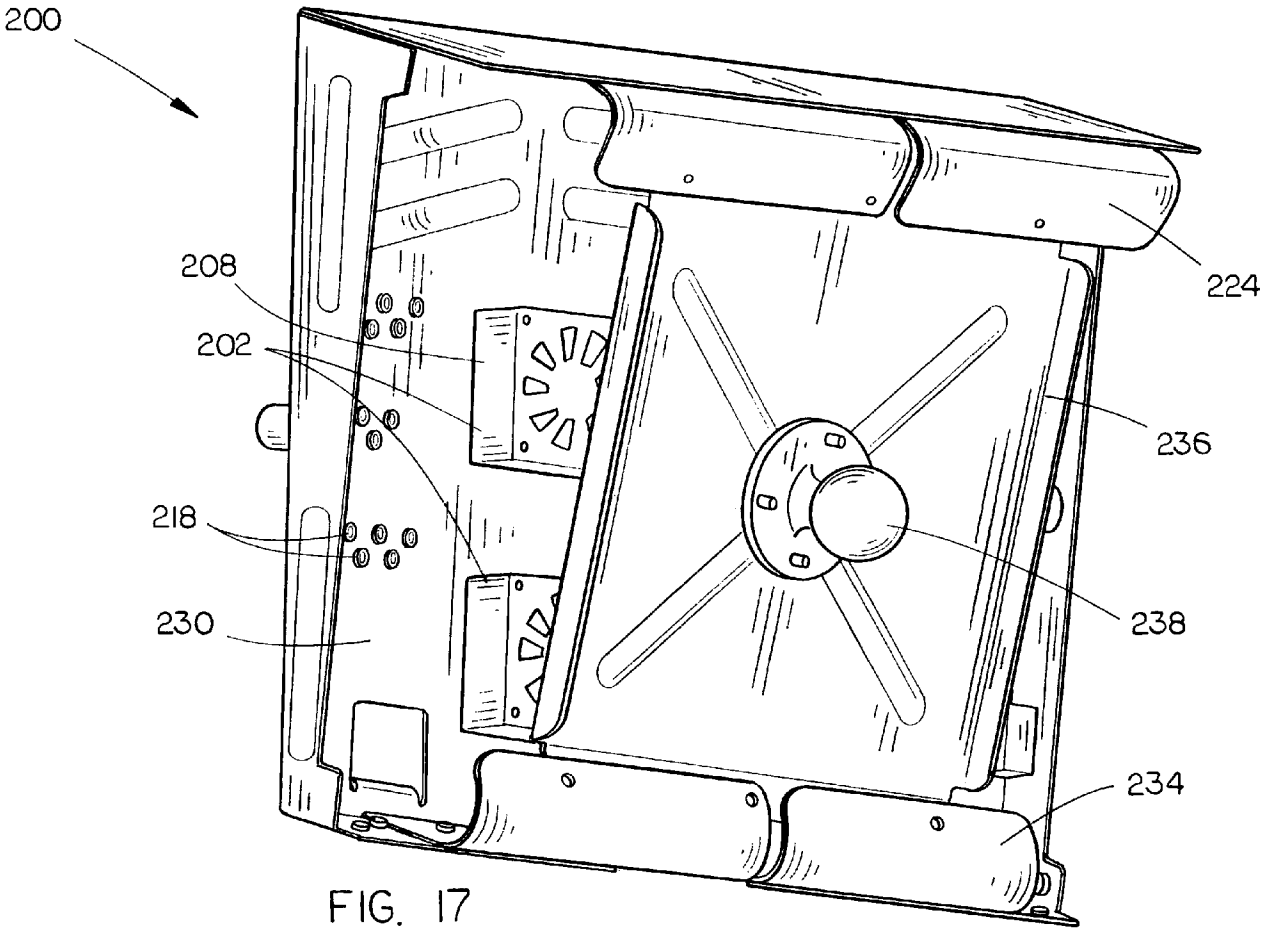
FIG. 17 is a back isometric view of a mounting apparatus comprising a plurality of cooling assemblies in accordance with an embodiment of the present invention.
Figure 18:
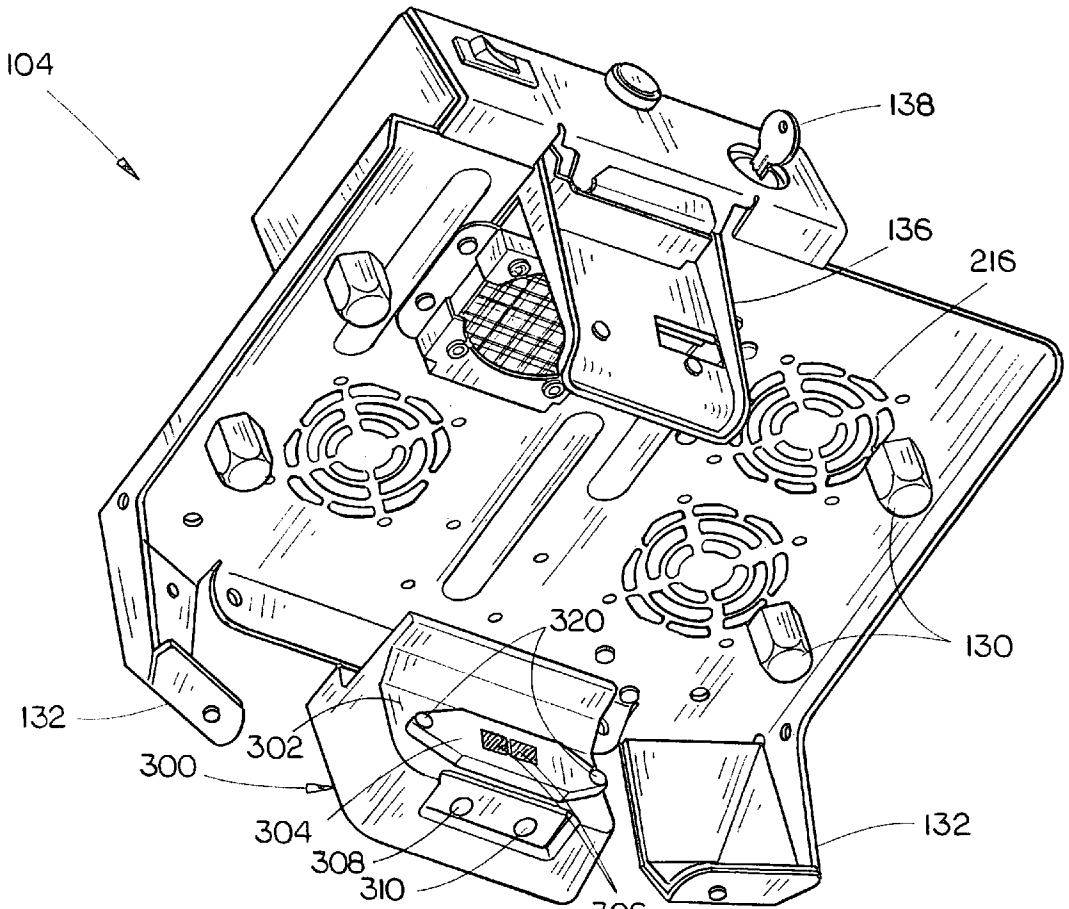
FIG. 18 is an isometric view of a mounting apparatus comprising a docking module in accordance with an embodiment of the present invention.
Figure 19:
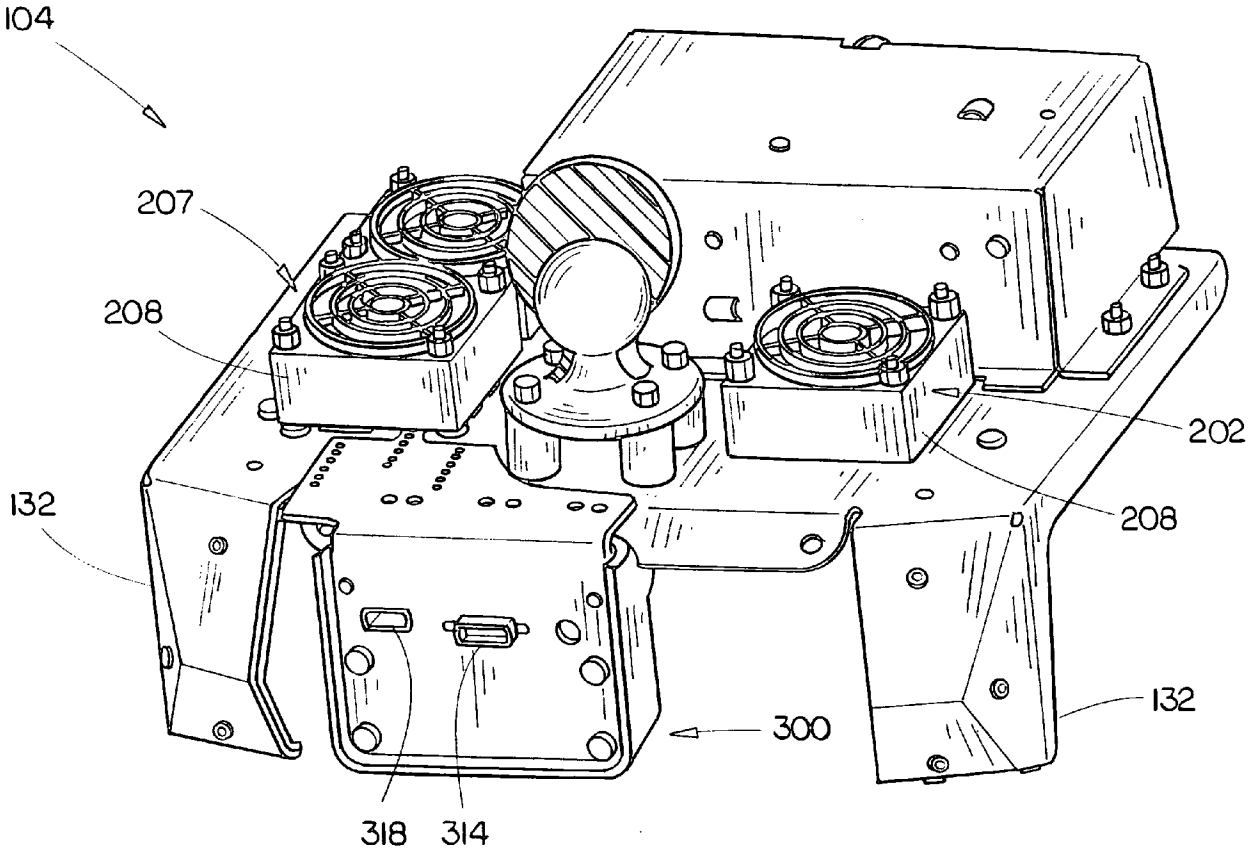
FIG. 19 is an additional isometric view of a mounting apparatus comprising a docking module in accordance with an embodiment of the present invention.

Referring to FIG. 17, a cooling mount 200 with a back support plate 236 coupled the adjustable height brackets 224, 234 is shown. Back support plate 236 may be implemented with a mounting post and linkage arm coupled to a frame assembly 102 for supporting a printing device, such as the frame assembly 102 shown in FIGS. 1-6. Back support plate 236 may comprise a coupling mechanism 238 such as a pivot joint or ball joint suitable for engaging with a companion coupling mechanism coupled to the frame assembly 102.

Referring to FIGS. 18-25, illustrations of a docking module suitable for integration with a mounting apparatus 100, or a cooling mount 200 are shown. Mounting apparatus 100, cooling mount 200 or mounting apparatus having a plurality of cooling assemblies 202 may further comprise a docking module 300. Docking module 300 may be comprised of a docking platform 302, and a contact assembly 304 upon which a plurality of contact pins 306 is placed. The docking module 300 may be suitable for receiving a mobile information handling device, and may connect to a network controller, an auxiliary power source and the like to allow mobile information handling device communications and charging. For instance, docking module 300 may be implemented with an information handling system, such as the T8600 computer, available from Mobile Demand, LLC with a docking assembly suitable for docking the information handling device and providing power, a USB connection, a LAN connection, and the like via the docking module 300.

Docking module 300 may be adjustably mounted to a surface of a mounting apparatus mount 104 or a cooling mount 200. Docking module 300 may further comprise at least four levels of adjustability and engagement of the electro-mechanical interface between a mobile information handling device and an electronic docking module. The docking module 300 may be mounted onto the mount 104 or cooling mount 200 via a plurality of apertures 318, 322 in the metal bracket. Docking module 300 may be adjustably mounted.

Docking module 300 may also be coupled to the mount 104 via a plurality of spring loaded assemblies (not shown). In one embodiment, docking module 300 may be coupled to the mount via at least 4 springs. It is contemplated, however, that any number of spring loaded assemblies may be utilized to couple the docking module 300 and the mount 104. Spring loaded assemblies may provide vertical travel for the docking module 300. In one instance, an embodiment of the present invention may comprise spring loaded assemblies allowing approximately 0.28" vertical travel for the docking module 300.

Figure 20:
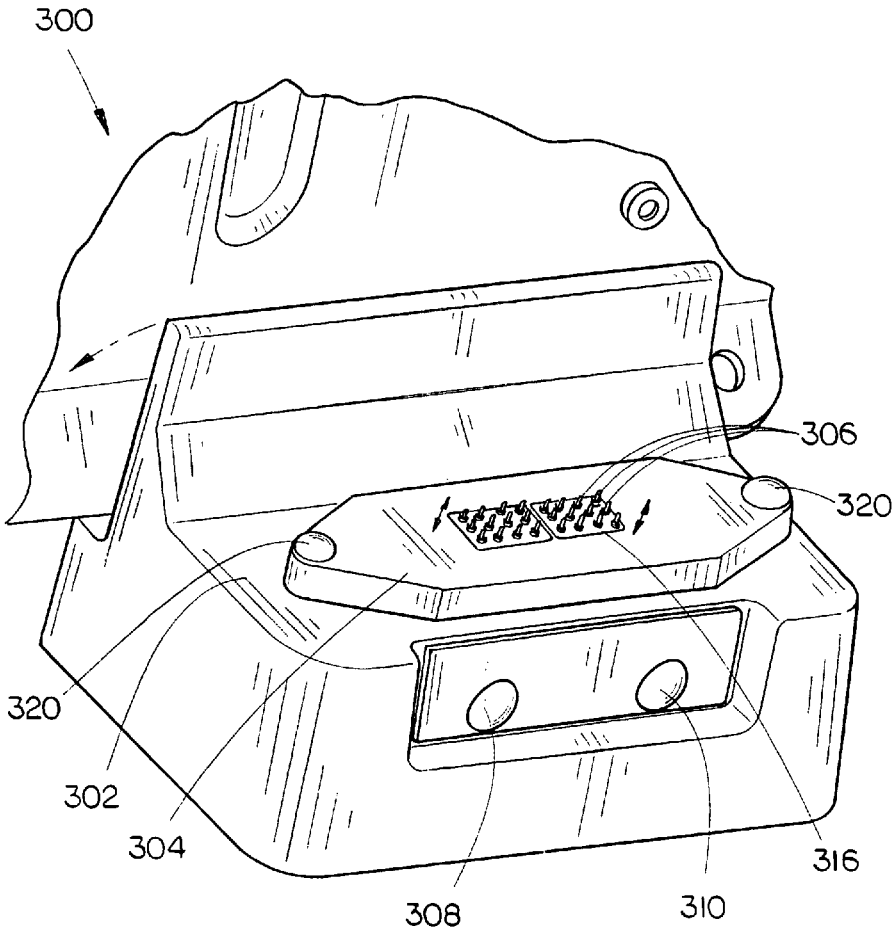
FIG. 20 is an exploded view of isometric view of a docking module of a mounting apparatus in accordance with an embodiment of the present invention.
Figure 21:
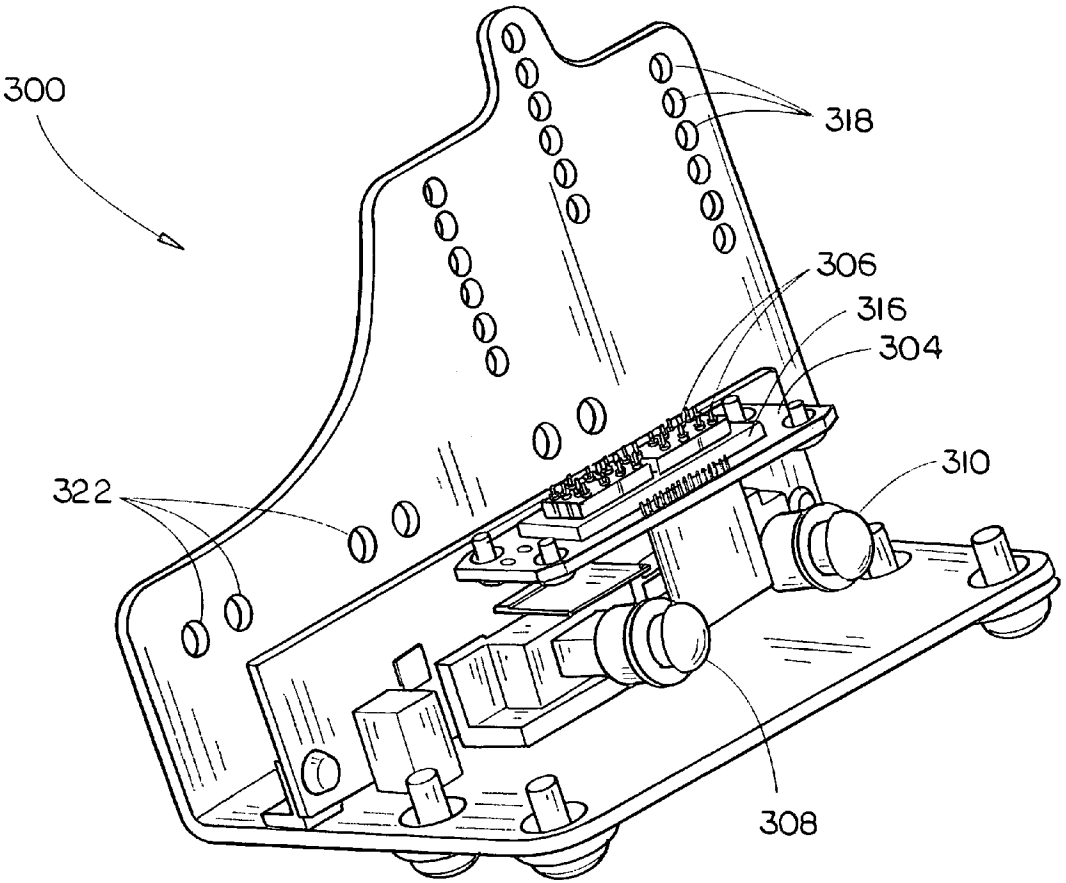
FIG. 21 is an isometric view of the components of a docking module of a mounting apparatus in accordance with an embodiment of the present invention.
Figure 22:
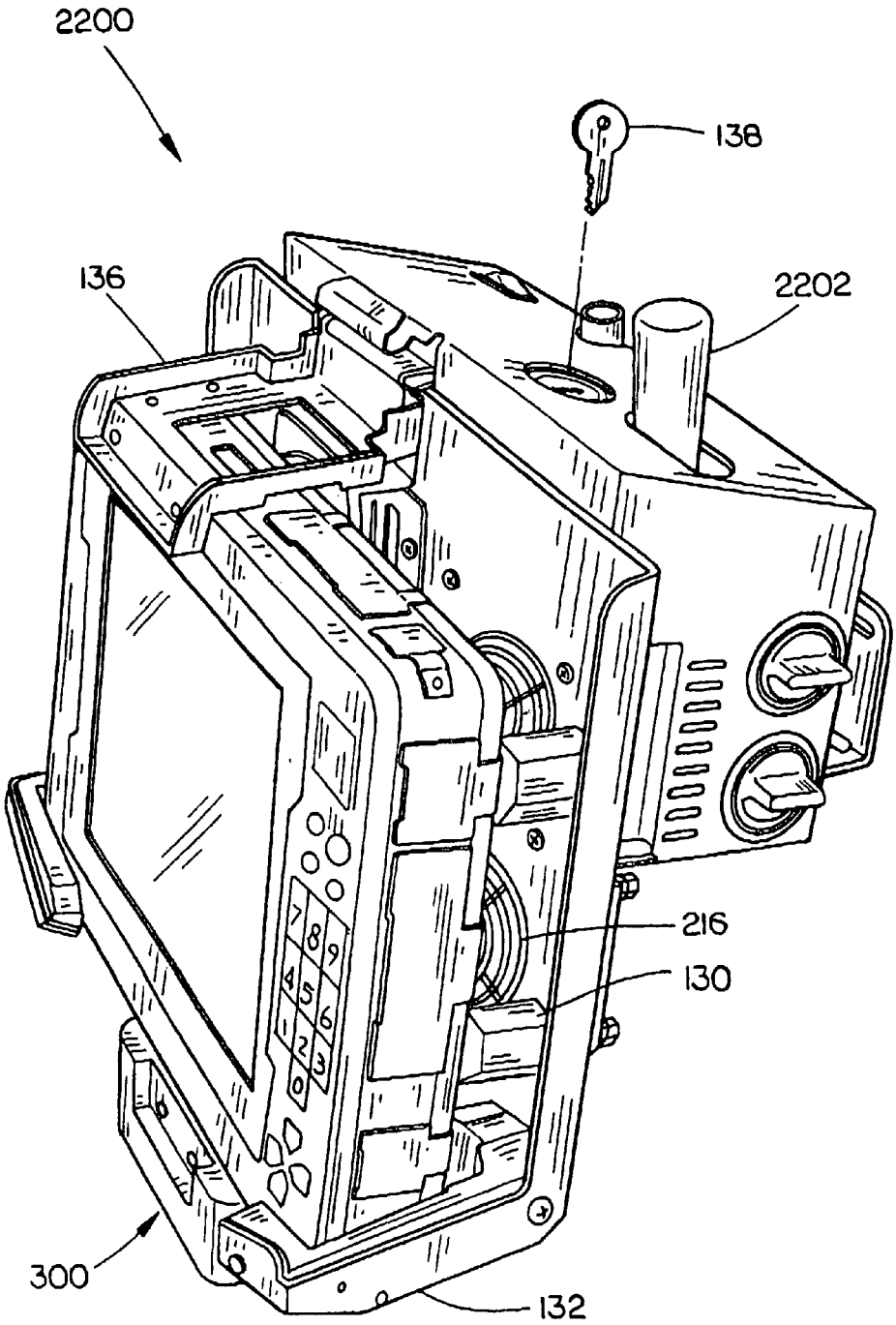
FIG. 22 is an additional isometric view of a mounting apparatus comprising a docking module in accordance with an embodiment of the present invention.
Figure 23:
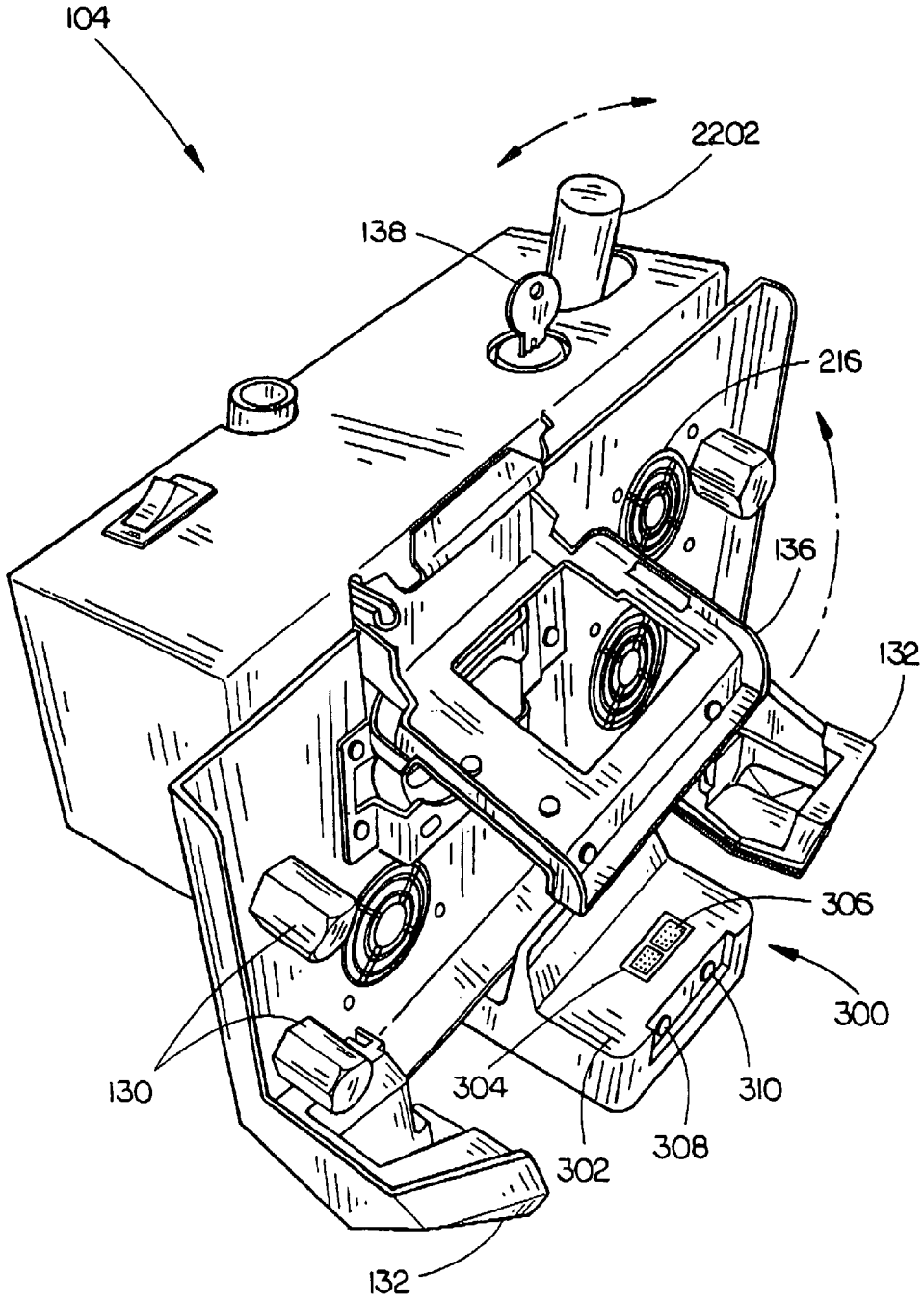
FIG. 23 is a further additional isometric view of a mounting apparatus comprising a docking module in accordance with an embodiment of the present invention.
Figure 24:
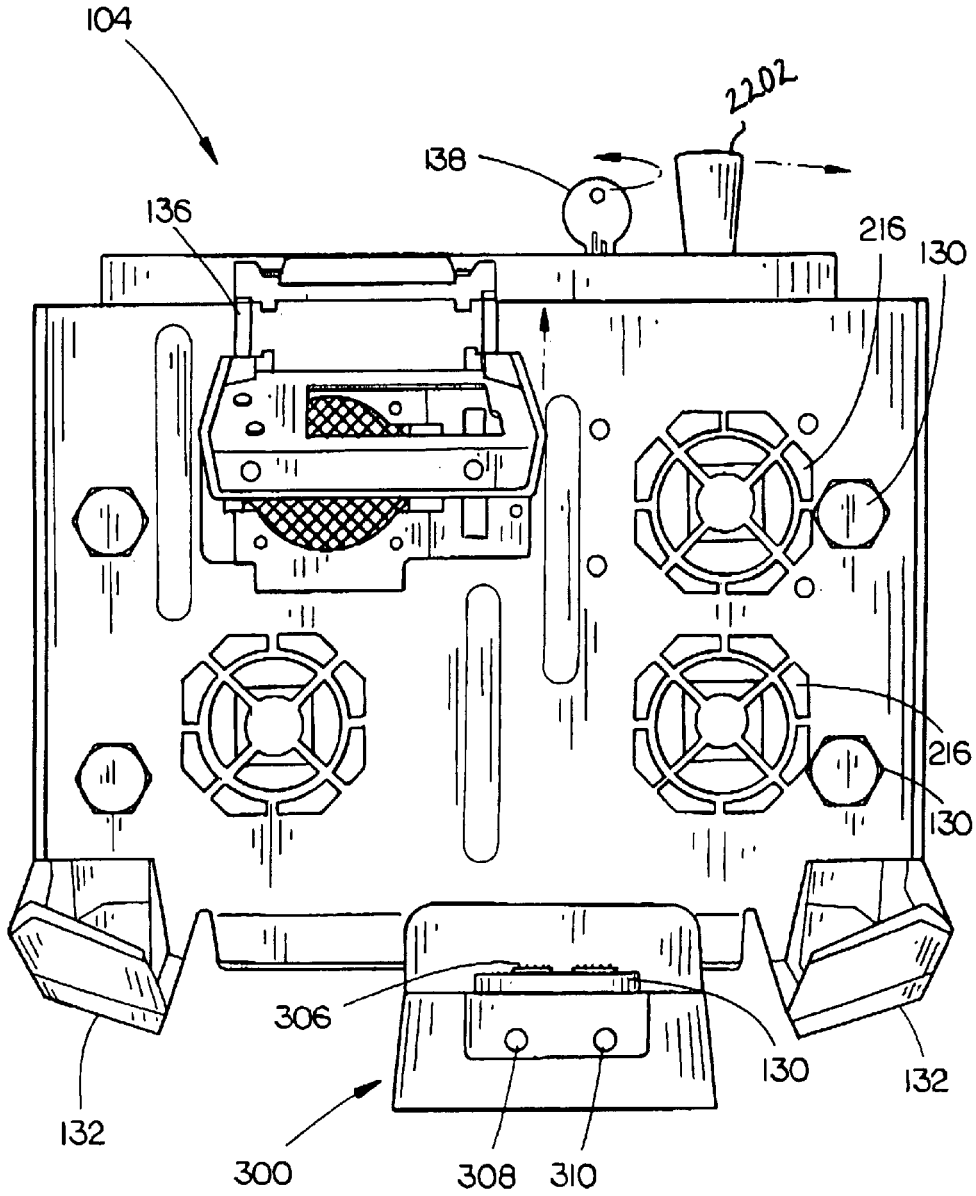
FIG. 24 is an front view of a mounting apparatus comprising a docking module in accordance with an embodiment of the present invention.
Figure 25:
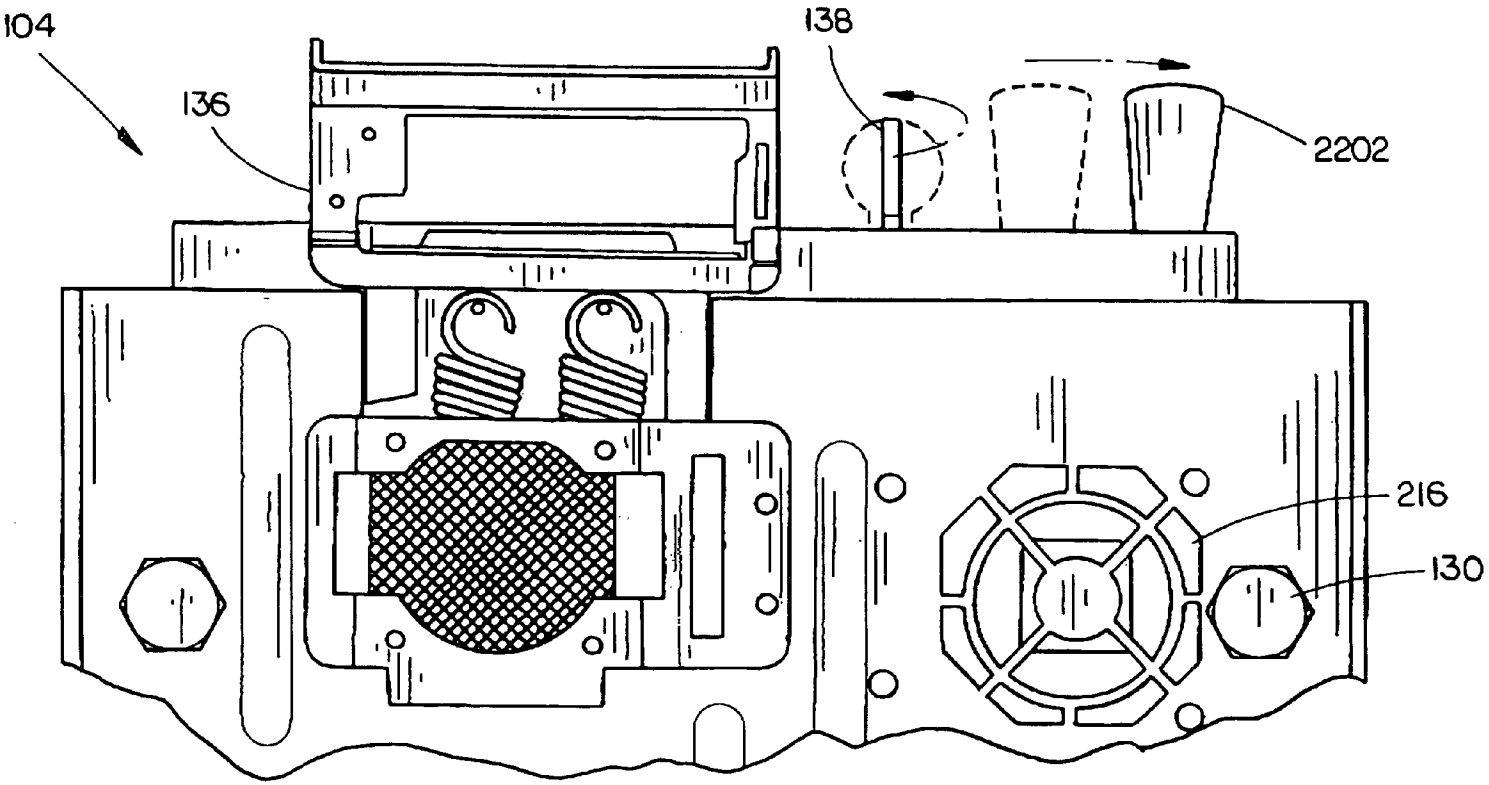
FIG. 25 is an exploded front view of a mounting apparatus illustrating latch assembly locking mechanisms in accordance with an embodiment of the present invention.

Referring to FIG. 20, a plurality of electrical contact pins 306 disposed at the lower end of the electronic docking module 300 is shown. Docking module 300 may be comprised of electrical contact pins 306 individually having an amount of vertical travel to compensate for variations in the height of the surface electrical contacts on an information handling device. For instance, contact pins 306 may each be spring loaded and configured to depress, independently of one another, into a contact pin receiving member 316 when a downward force is applied to one or more contact pins 306. In one embodiment, spring loaded contact pins 306 may have approximately 1.5 mm of travel. It is contemplated, however, that spring loaded pins may have any amount of travel suitable for providing interconnection between a docking module 300 and an information handling device. In some instances, contact pins 306 may be substantially large or small and may travel a substantially larger or smaller distance as may be necessary or desired.

It is contemplated that docking module 300 may comprise at least two rows of contact pins 306. Each contact pin 306 may comprise a formed conductive element and may be constructed of electrically conductive material. Each contact pin 306 may be fitted into a contact receiving member 316 such that contact pins 306 are spaced apart in generally parallel relationship. The contact receiving member 316 is composed of a non-conductive or insulating material. It is further contemplated that the two rows of pins 306 may comprise pins of differing heights. For instance, ground pins may be longer than non ground pins. Longer ground pins may provide superior electrostatic discharge protection. Specifically, longer ground pins may dissipate electrostatic energy prior to the electrical connection of a mobile information handling device and a docking module 300.

Docking module may further comprise a plurality of raised areas 320, such as hemispherical bumps adjacent to the spring loaded assembly to provide mechanical alignment. Raised areas 320 may be configured to be inserted into one or more indents disposed on a mobile information handling device.

Also, the engagement between the pins 306 of the docking module 300 and the surface contacts of the mobile information handling device may remain bounce resistant while the data terminal is retained in the docking module 300. The engagement between the surface contacts of the mobile information handling device and the contact pins 306 of the docking module 300 may be utilized to couple both power and system communication to the data terminal. Thus, on a reverse side of the docking module, power 312 and communications 314 connectors may couple the docking device, for example, to RS 232, RS 485, Ethernet local area network (LAN) hard wired cables, and also provide proper external power to operate the data terminal and to recharge its internal batteries during docking periods. The plurality of connectors 312, 314 may represent any typical communications and power connections. A docking module 300 may further comprise an interface and power supply means for energizing these components from vehicle electric power, such as vehicle electric power being available e.g. from a twelve-volt direct current plug-in power receptacle adjacent each connection.

Referring specifically to FIGS. 22-25, additional illustrations of a mounting apparatus comprising a plurality of cooling assemblies 202, a docking module 300 and a latch assembly 136 are shown. In a further additional embodiment, a mount 104 comprising at least one cooling assembly 202 may further comprise a latch assembly securing mechanism 136 configured to power on and off the at least one cooling assembly. Latch assembly 136 may pivot to a desired orientation, and may be secured at the orientation via the lock and key assembly 138, a slideable bolt assembly 2202, and the like. For instance, when latch assembly 136 is secured in a desired position, the turning of lock and key assembly 138, sliding of the bolt assembly 2202, or the position of the latch assembly 136 may trigger the at least one cooling assembly 202 to power on. Likewise, releasing the latch assembly 136 by rotating the latch assembly substantially upward, unlocking the lock and key assembly 138, or sliding the slideable bolt assembly 2202 in an opposite direction may cause the cooling assembly 202 to power off.

Figure 26:
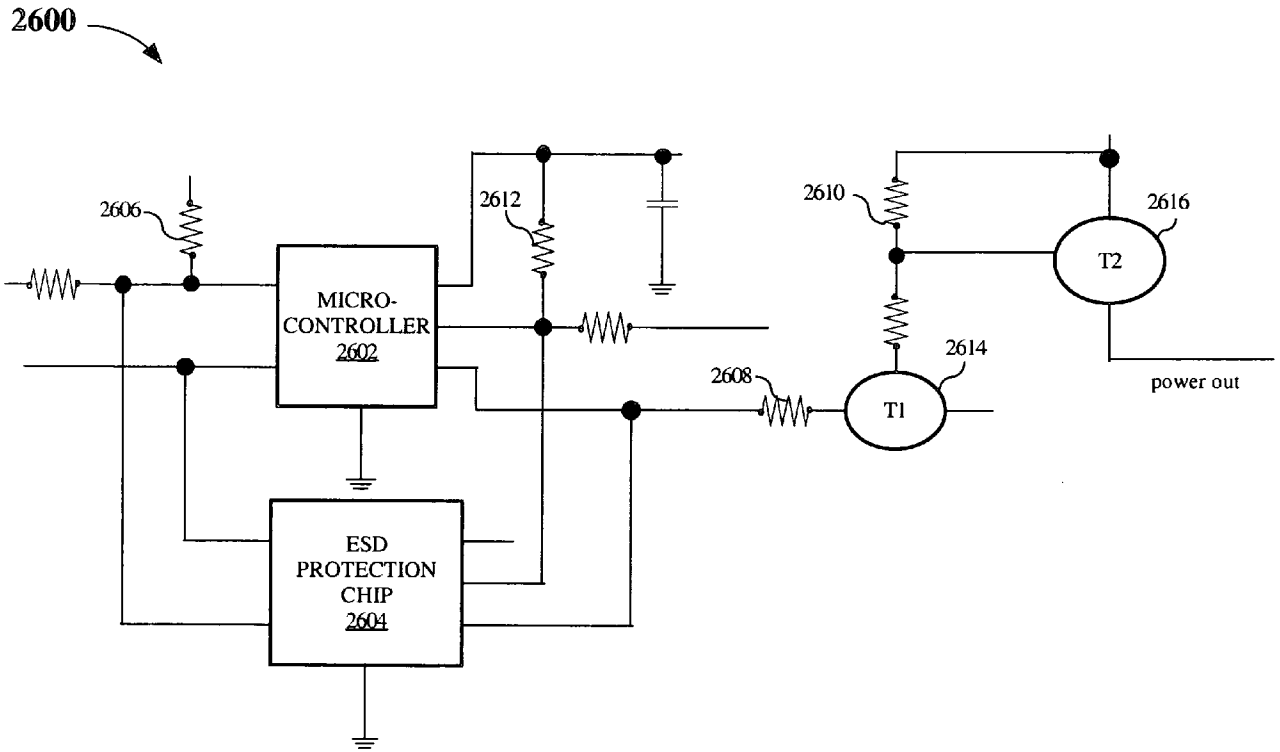
FIG. 26 is a schematic diagram illustrating docking of a mounting apparatus in accordance with an embodiment of the present invention.

Referring to FIG. 26, a schematic diagram of a circuit 2600 for detecting mobile information handling device connectivity via a docking module 300 according to an exemplary embodiment of the present invention is shown. Circuit 2600 comprises a programmed microcontroller 2602 suitable for testing at least one pin of the pin assembly to determine if a mobile information handling device is connected. Circuit 2600 further comprises an electrostatic discharge (ESD) protection chip 2604 configured to prevent electro static discharge coupled with the programmed microcontroller, a plurality of resistors, for example, 2606-2612 and a plurality of transistors 2614, 2616. At least one of the plurality of transistors is suitable for providing power switching to a mobile information handling device. Circuit 2600 is suitable for preventing pins from maintaining an active or live status when a mobile information handling device is not docked. Circuit programmed microcontroller 2602 senses a connection of a mobile information handling device from the docking module 300 and disconnection of a mobile information handling device from the docking module 300. Circuit 2600 may also comprise a voltage regulator configured to provide an amount of voltage to the mobile information handling device. Provided voltage may be greater than the battery supplied voltage of the mobile information handling device battery. For instance, voltage regulator may provide 19 volts to the mobile information handling device to allow the mobile information handling device to draw from the greater voltage source.

It is contemplated that a mobile information handling device and a docking module 300, may electronically detect the presence of one another. The docking detection circuit 2200 of the docking module 300 is configured to detect the presence of the mobile information handling device docked in the docking module 300 by sensing the continuity of at least two of the contact pins 306 to the remaining spring loaded contact pins 306. Ground detection pins may be positioned along an outer edge of the contact assembly such that, by applying AND logic to a ground pin, connection of the entire connector may be sensed when a mobile information handling device is in contact with the dock. Ground continuity may be sensed by maintaining a weak electrical pull of at least two electrical contacts 306 to a logical high through a pull-up resistor and allowing a mobile information handling device pull at least one contact pin 306 to a logical low state by connecting the contact pin 306 to ground. The microcontroller 2602 senses the logical state through a CMOS input and applies the AND logic internally. Once the state of both pins remains a logical low simultaneously and continuously for three seconds, the power to the mobile information handling device is switched on using the microcontroller's general purpose CMOS output to control the gate of a P-channel MOSFET transistor that is a series high-side switch for the mobile information handling device power. The power is switched off after a half-second of either sense pin being disconnected. The purpose of this power switching to is to avoid applying power to the dock when the mobile information handling device is not in the dock, or when it being placed on the dock to avoid shorting and damage to the contact pins 306 or the internal circuitry of the mobile information handling device. Upon detection, automatically, via electronics, the docking module 300 may receive the data signals activated on the computer and made available to the surface contacts on the mobile information handling device to pass through to a data connector such as a USB, a DB9 and the like on the electronic docking module 300.

The mobile information handling device may utilize a similar technique of sensing a ground connection supplied by the docking module 300 in order to gate the USB power sourced by the unit on its surface contacts. One surface contact may be weakly pulled to a logical high and when it is grounded to a logical low by the dock it enables the USB supply regulator and the RS232 serial port driver. Weak pull of at least one surface contact may prevent a shorting of the USB power to ground while the mobile information handling device is not placed on the docking module 300.

Figure 27:
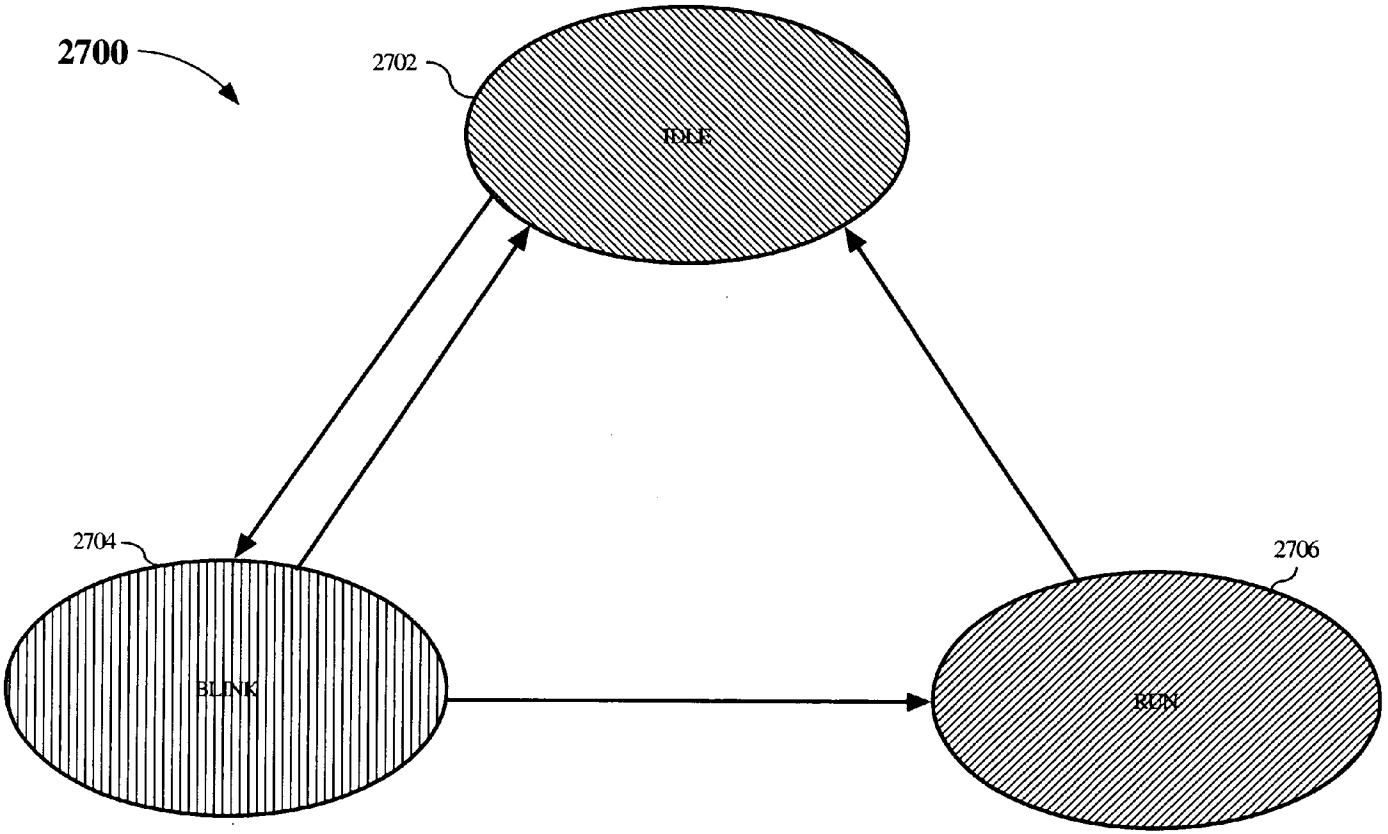
FIG. 27 is a diagram of visual docking confirmation of a docked mounting apparatus in accordance with an embodiment of the present invention.

Referring to FIG. 27, an illustration of LED activation 2700 is shown. Docking module 300 may comprise at least a first LED assembly 308 and a second LED assembly 310 configured to provide visual confirmation of connection between a mobile information handling device and a power supply supplied via the docking module 300 when the a mobile information handling device is mounted onto the mount 104 or cooling mount 200. One or more LED assemblies 308, 310 coupled with the docking module 300 may be configured to power on when a mobile information handling device is mounted onto the mount 100. Connectivity state may be sensed on at least one of the electrical contacts. In an idle state 2702, no ground is sensed on the surface electrical contact, and an LED assembly 308 may be in an off mode, with no lighted color visible (represented by a left-to-right diagonal stripe in FIG. 27). If at least two surface electrical contacts sense a ground, an LED 308 may blink 2704 a first color, such as yellow (represented by a vertical stripe in FIG. 27). LED assembly 308 may blink for a time period, such as at least 3 seconds and, if ground is detected after the end of the time period, LED assembly 308 may run 2706 (represented by a right-to-left diagonal stripe in FIG. 27).

One LED assembly 308 may provide an indication of the docking module 300 receiving power from an outside source. An additional LED assembly 310 may flash when the beginning of a docking event occurs. For instance, when a mobile information handling device is detected as being docked in the docking module, the second LED assembly 310 may flash for an amount of time, such as approximately 3 more seconds, and then remain solid. A solid colored second LED assembly 310 may indicate that the data signal lines between the mobile information handling device and the external connectors are enabled.

It is to be noted that the foregoing described embodiments according to the present invention may be conveniently implemented using conventional general purpose digital computers programmed according to the teachings of the present specification, as will be apparent to those skilled in the computer art. Appropriate software coding may readily be prepared by skilled programmers based on the teachings of the present disclosure, as will be apparent to those skilled in the software art.

It is to be understood that aspects of the present invention may be conveniently implemented in forms of a software package. Such a software package may be a computer program product which employs a computer-readable storage medium including stored computer code which is utilized to program a computer to perform the disclosed function and process of the present invention. The computer-readable medium may include, but is not limited to, any type of conventional floppy disk, optical disk, CD-ROM, magneto-optical disk, ROM, RAM, EPROM, EEPROM, magnetic or optical card, or any other suitable media for storing electronic instructions.

It is believed that the various embodiments of the apparatus and system of the present invention and many of their attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof.

What is claimed:

1. An apparatus for mounting a mobile information handling device, comprising:

a mount for mounting the mobile information handling device;

at least one cooling assembly coupled to the mount configured for cooling the mobile information handling device mounted on the mount;

a plurality of stabilization assemblies configured for stabilizing the mobile information handling device when mounted on the mount by minimizing lateral shifting of the mobile information handling device relative to the mount;

at least one securing assembly coupled to the mount along an axis defined by the plurality of stabilization assemblies to provide lateral support to the mobile information handling device when mounted on the mount, wherein:

the mobile information handling device comprises one of a tablet computer, a laptop computer, a cellular telephone and a personal digital assistant; and the at least one securing assembly comprises a vertical post member suitable for insertion in an aperture on the mount and an elongated horizontal top member suitable for resting substantially on a top surface of the mobile information handling device mounted on the mount to prevent movement of the mobile information handling device along a vertical axis.

2. The apparatus as claimed in claim 1, wherein the mount comprises a plurality of apertures shaped to allow air generated from the at least one cooling assembly to flow therethrough.

3. The apparatus as claimed in claim 2, further comprising a plurality of spacer elements positioned about the perimeter of at least one of the plurality of apertures suitable for providing an amount of space between the mount and the mobile information handing device.

4. The apparatus as claimed in claim 1, wherein the at least one cooling assembly comprises an electro-mechanical switch arrangement suitable for providing power to the at least one cooling assembly when the mobile information handling device is mounted on the mount.

5. The apparatus as claimed in claim 1, wherein the at least one cooling assembly comprises a motor, at least one blade driven by the motor and a housing for receiving the at least one blade.

6. The apparatus as claimed in claim 1, wherein the at least one cooling assembly is permanently coupled to a surface of the mount.

7. The apparatus as claimed in claim 1, wherein the at least one cooling assembly is detachably coupled to a surface of the mount.

8. The apparatus as claimed in claim 1, wherein each of the plurality of stabilization assemblies is one of a post, a stopper, a block or a raised element permanently or releasably coupled to the mount substantially adjacently to the mobile information handling device when mounted on the mount.

9. The apparatus as claimed in claim 1, wherein the mount further comprises a support ledge suitable for providing upward support for the mobile information handling device when mounted on the mount.

10. The apparatus as claimed in claim 1, wherein the mount further comprises a latch assembly securing mechanism configured to secure a mobile information handling device to the mount, and further configured to power on the at least one cooling assembly when the latch assembly securing mechanisms is in a first orientation and power off the at least one cooling assembly when the at least one latch assembly securing mechanism is in a second orientation.

11. An apparatus for mounting a mobile information handling device, comprising:

a mount for mounting the mobile information handling device, the mount further comprising:

at least one cooling assembly coupled to a back surface of the mount suitable for cooling the mobile information handling when device mounted on the mount;

a plurality of apertures formed through the mount and shaped to allow air generated by the at least one cooling assembly to flow therethrough;

a plurality of spacer elements coupled to a front surface of the mount about the perimeter of at least one of the plurality of apertures configured for providing an amount of space between the mount and the mobile information handing device when mounted on the mount;

a plurality of stabilization assemblies configured for stabilizing the mobile information handling device when mounted on the mount by minimizing lateral shifting of the mobile information handling device relative to the mount; and at least one securing assembly coupled to the mount along an axis defined by the plurality of stabilization assemblies to provide lateral support to the mobile information handling device when mounted on the mount, wherein:

the mobile information handling device comprises one of a tablet computer, a laptop computer, a cellular telephone and a personal digital assistant; and the at least one securing assembly comprises a vertical post member suitable for insertion in an aperture on the mount and an elongated horizontal top member suitable for resting substantially on a top surface of the mobile information handling device mounted on the mount to prevent movement of the mobile information handling device along a vertical axis.

12. The apparatus as claimed in claim 11, wherein the at least one cooling assembly comprises an electro-mechanical switch arrangement suitable for initiating a cooling assembly blade movement in a substantially circular direction when the mobile information handling device is set in place.

13. The apparatus as claimed in claim 11, wherein the at least one cooling assembly comprises a motor, at least one blade driven by the motor and a housing for receiving the at least one blade.

14. The apparatus as claimed in claim 11, wherein each of the plurality of stabilization assemblies is one of a post, a stopper, a block or a raised element permanently or releasably coupled to the mount substantially adjacently to the mobile information handling device when mounted on the mount.

* * * * *